US006165411A

United States Patent [19]

Adachi et al.

[11] Patent Number: 6,165,411

[45] Date of Patent: Dec. 26, 2000

[54] APPARATUS FOR PRODUCING METAL TO BE SEMIMOLTEN-MOLDED

[75] Inventors: Mitsuru Adachi; Satoru Sato; Yasunori Harada; Takashi Kawasaki, all of Ube, Japan

[73] Assignee: UBE Industries, Ltd., Ube, Japan

[21] Appl. No.: 09/051,936

[22] PCT Filed: Nov. 28, 1997

[86] PCT No.: PCT/JP97/04348

§ 371 Date: Apr. 5, 1999

§ 102(e) Date: Apr. 5, 1999

[87] PCT Pub. No.: WO98/23403

PCT Pub. Date: Jun. 4, 1998

[30] Foreign Application Priority Data

Nov. 28, 1987 [JP] Japan ..... 9-324294
Nov. 28, 1996 [JP] Japan ..... 8-317314

[51] Int. Cl.[7] ..... B22D 17/08; B22D 23/00; B22D 27/00

[52] U.S. Cl. ..... 266/135; 266/241; 266/242; 164/312

[58] Field of Search ..... 266/135, 241, 266/242; 164/71.1, 113, 122, 127, 312, 900, 4.1

[56] References Cited

U.S. PATENT DOCUMENTS

| | | | |
|---|---|---|---|
| 5,501,266 | 3/1996 | Wang et al. | 164/113 |
| 5,533,562 | 7/1996 | Moschini et al. | 164/71.1 |
| 5,697,425 | 12/1997 | Nanba et al. | 164/468 |
| 5,701,942 | 12/1997 | Adachi et al. . | |
| 5,730,198 | 3/1998 | Sircar | 164/4.1 |
| 5,758,707 | 6/1998 | Jung et al. | 164/4.1 |

FOREIGN PATENT DOCUMENTS

| | | |
|---|---|---|
| 719606 | 7/1996 | European Pat. Off. . |
| 7-32113 | 2/1995 | Japan . |
| 8-57587 | 3/1996 | Japan . |
| 8-117947 | 5/1996 | Japan . |
| 8-187547 | 7/1996 | Japan . |
| 8-243707 | 9/1996 | Japan . |

*Primary Examiner*—Scott Kastler
*Attorney, Agent, or Firm*—Frishauf, Holtz, Goodman, Langer & Chick, P.C.

[57] ABSTRACT

An improved apparatus for producing a semisolid shaping metal that has fine primary crystals dispersed in the liquid phase and which also has a uniform temperature distribution comprises a melt pouring section comprising a melting furnace which melts and holds a metal and a pouring device which lifts out the molten metal from said melting furnace, adjusts it to a specified temperature and pours it into a holding vessel, a nucleating section which generates crystal nuclei in the melt as it is supplied from said pouring device into said holding vessel, a crystal generating section which performs temperature adjustment such that the metal obtained from said nucleating section falls within a desired molding temperature range as it is cooled to a molding temperature at which it is partially solid, partially liquid, a holding vessel heating section which adjusts the temperature of the holding vessel when it is empty, a holding vessel conditioning section which inverts the holding vessel so that a partially molten metal is discharged and which then cleans the inner surfaces of the holding vessel, and a vessel transporting section furnished with an automating device including a robot with which the partially molten metal from said nucleating section is transported into the injection sleeve of a molding machine.

14 Claims, 18 Drawing Sheets

Notes)

P: Effecting steps (1) and (2)

Holding in semisolid state: Effecting steps (3)-a and (3)-b

C: Effecting steps (3)-c and (4)

ABS: Effecting cleaning spray

W: waiting time r-f heating apparatus: 3 units heating of holding vessels: 4 vessels shot cycle: 60 sec.

(a)

(b)

(a)

(b)

(a)

(b)

APPARATUS FOR PRODUCING METAL TO BE SEMIMOLTEN-MOLDED

TECHNICAL FIELD

This invention relates to an apparatus for producing semisolid shaping metals. More particularly, the invention relates to an apparatus with which semisolid metals suitable for semisolid shaping that have fine primary crystals dispersed in the liquid phase and that have a uniform temperature distribution can be produced in a very convenient and easy way.

BACKGROUND ART

A thixo-casting process is drawing researcher's attention these days since it involves a fewer molding defects and segregations, produces uniform metallographic structures and features longer mold lives but shorter molding cycles than the existing casting techniques. The billets used in this molding method (A) are characterized by spheroidized structures obtained by either performing mechanical or electromagnetic agitation in temperature ranges that produce semisolid metals or by taking advantage of recrystallization of worked metals.

On the other hand, raw materials cast by the existing methods may also be molded in a semisolid state. There are three examples of this approach; the first two concern magnesium alloys that will easily produce an equiaxed microstructure and Zr is added to induce the formation of finer crystals [method (B)] or a carbonaceous refiner is added for the same purpose [method (C)]; the third approach concerns aluminum alloys and a master alloy comprising an Al-5% Ti-1% B system is added as a refiner in amounts ranging from 2–10 times the conventional amount [method (D)]. The raw materials prepared by these methods are heated to temperature ranges that produce semisolid metals and the resulting primary crystals are spheroidized before molding.

It is also known that alloys within a solubility limit are heated fairly rapidly up to a temperature near the solidus line and, thereafter, in order to ensure a uniform temperature distribution through the raw material while avoiding local melting, the alloy is slowly heated to an appropriate temperature beyond the solidus line so that the material becomes sufficiently soft to be molded [method (E)]. A method is also known, in which molten aluminum at about 700° C. is cast to flow down an inclined cooling plate to form partially molten aluminum, which is collected in a vessel [method (F)].

These methods in which billets are molded after they are heated to temperatures that produce semisolid metals are in sharp contrast with a rheo-casting process (G), in which molten metals containing spherical primary crystals are produced continuously and molded as such without being solidified to billets. It is also known to form a rheo-casting slurry by a method in which a metal which is at least partially solid, partially liquid and which is obtained by bringing a molten metal into contact with a chiller and inclined chiller is held in a temperature range that produces a semisolid metal [method (H)].

Further, a casting apparatus (I) is known which produces a partially solidified billet by cooling a metal in a billet case either from the outside of a vessel or with ultrasonic vibrations being applied directly to the interior of the vessel and the billet is taken out of the case and shaped either as such or after reheating with r-f induction heater.

However, the above-described conventional methods have their own problems. Method (A) is cumbersome and the production cost is high irrespective of whether the agitation or recrystallization technique is utilized. When applied to magnesium alloys, method (B) is economically disadvantageous since Zr is an expensive element and speaking of method (C), in order to ensure that carbonaceous refiners will exhibit their function to the fullest extent, the addition of Be as an oxidation control element has to be reduced to a level as low as about 7 ppm but then the alloy is prone to burn by oxidation during the heat treatment just prior to molding and this is inconvenient in operations.

In the case of aluminum alloys, about 500 $\mu$m is the crystal grain size that can be achieved by the mere addition of refiners and it is not easy to obtain crystal grains finer than 200 $\mu$m. To solve this problem, increased amounts of refiners are added in method (D) but this is industrially difficult to implement because the added refiners are prone to settle on the bottom of the furnace; furthermore, the method is costly. Method (E) is a thixo-casting process which is characterized by heating the raw material slowly after the temperature has exceeded the solidus line such that the raw material is uniformly heated and spheroidized. In fact, however, an ordinary dendritic microstructure will not transform to a thixotropic structure (in which the primary dendrites have been spheroidized) upon heating. According to method (F), partially molten aluminum having spherical particles in the microstructure can be obtained conveniently but no conditions are available that provide for direct shaping. What is more, thixo-casting methods (A)–(F) have a common problem in that they are more costly than the existing casting methods because in order to perform molding in the semisolid state, the liquid phase must first be solidified to prepare a billet, which is heated again to a temperature range that produces a semisolid metal. In addition, the billets as the starting material are difficult to recycle and the fraction liquid cannot be increased to a very high level because of handling considerations.

In contrast, method (G) which continuously generates and supplies a molten metal containing spherical primary crystals is more advantageous than the thixo-casting approach from the viewpoint of cost and energy but, on the other hand, the machine to be installed for producing a metal material consisting of a spherical structure and a liquid phase requires cumbersome procedures to assure effective operative association with the casting machine to yield the final product. Specifically, if the casting machine fails, difficulty arises in the processing of the semisolid metal.

Method (H) which holds the chilled metal for a specified time in a temperature range that produces a semisolid metal has the following problem. Unlike the thixo-casting approach which is characterized by solidification into billets, reheating and subsequent shaping, the method (H) involves direct shaping of the semisolid metal obtained by holding in the specified temperature range for a specified time and in order to realize industrial continuous operations, it is necessary that an alloy having a good enough temperature distribution to establish a specified fraction liquid suitable for shaping should be formed within a short time. However, the desired rheo-casting semisolid metal which has spherical primary crystals, a fraction liquid and a temperature distribution that are suitable for shaping cannot be obtained by merely holding the cooled metal in the specified temperature range for a specified period. Too rapid cooling will deteriorate the temperature distribution. In addition, if the cooling means is contacted by the melt, a solidified metal will remain either on the cooling means or within the holding vessel, making it impossible to perform continuous operation.

In method (I), a case for cooling the metal in a vessel is employed but the top and the bottom portions of the metal in the vessel will cool faster than the center and it is difficult to produce a partially solidified billet having a uniform temperature distribution and immediate shaping will yield a product of nonuniform structure. What is more, considering the need to satisfy the requirement that the partially solidified billets as taken out of the billet case have such a temperature that the initial state of the billet is maintained, it is difficult for the fraction liquid of the partially solidified billet to exceed 50% and the maximum that can be attained practically is no more than about 40%, which makes it necessary to give special considerations in determining injection and other conditions for shaping by diecasting. If the fraction liquid of the billet has dropped below 40%, it could be reheated with a r-f induction heater but it is still difficult to attain a fraction liquid in excess of 50% and special considerations must be made in injection and other shaping conditions. In addition, eliminating any significant temperature uneveness that has occurred within the partially solidified billet is a time-consuming practice and it is required, although for only a short time, that the r-f induction heater produces a high power comparable to that required in thixo-casting. In addition it is necessary to install multiple units of the r-f induction heater in order to achieve continuous operation in short cycles.

Another problem with the industrial practice of shaping semisolid metals in a continuous manner is that if a trouble occurs in the casting machine, the semisolid metal may occasionally be held in a specified temperature range for a period longer than the prescribed time. Unless a certain problem occurs in the metallographic structure, it is desired that the semisolid metal be maintained at a specified temperature; in practice, however, particularly in the thixo-casting process where the semisolid metal is held with its temperature elevated from room temperature, the metallographic structure becomes coarse and the billets are considerably deformed (progressively increase in diameter toward the bottom). In addition, unless their temperatures are individually controlled, such billets are usually discarded and cannot be used as thixo-billets.

The present invention has been accomplished under these circumstances of the prior art and its principal object is to provide an apparatus that does not require to use billets or any cumbersome procedures but which ensures that semisolid metals (including those which have higher values of fraction liquid than what are obtained by the conventional thixo-casting process) which are suitable for subsequent shaping on account of both a uniform structure containing spheroidized primary crystals and uniform temperature distribution can be produced in a convenient, easy cost-effective way. In addition, if the need arises to control the semisolid metal by holding it at a specified temperature during prolonged machine trouble or in the case where a semisolid metal having a specified fraction liquid is rapidly produced to permit high shot-cycle operations and where it is adjusted to fall within a specified temperature range prior to molding, the apparatus is capable of producing a semisolid metal suitable for semisolid shaping by holding the metal's temperature uniformly at a constant level with such great rapidity that the power requirement of the r-f induction heater is no more than 50% of what is commonly spent in shaping by the thixo-casting process.

DISCLOSURE OF INVENTION

The stated object of the invention can be attained by the apparatus of a first embodiment of present invention for producing a semisolid shaping metal that has fine primary crystals dispersed in the liquid phase and which also has a uniform temperature distribution, said apparatus comprising a melt pouring section comprising a melting furnace which melts and holds a metal and a pouring device which lifts out the molten metal from said melting furnace, adjusts it to a specified temperature and pours it in a holding vessel, a nucleating section which generates crystal nuclei in the melt as it is supplied from said pouring device into said holding vessel, a crystal generating section which performs temperature adjustment such that the metal obtained from said nucleating section falls within a desired molding temperature range as it is cooled to a molding temperature at which it is partially solid, partially liquid, a holding vessel conditioning section which inverts the holding vessel by turning it upside down so that a partially molten metal is discharged and which then cleans the inner surfaces of the holding vessel, and a vessel transporting section furnished with an automating device including a robot with which the partially molten metal from said nucleating section is transported into the injection sleeve of a molding machine.

According to a second embodiment of the present invention, the melt pouring section of the apparatus of the first embodiment of the present invention comprises, (1) a high-temperature melt holding furnace and a low-temperature melt holding furnace furnished with a pouring ladle, or (2) a pouring ladle furnished with a refiner feed unit and a temperature control cooling jig inserting device and a high-temperature melt holding furnace, or (3) a low-temperature melt holding furnace furnished with a pouring ladle and a refiner-rich melt holding furnace also furnished with a pouring ladle, (4) a pouring ladle furnished with a refiner melting radio-frequency induction heater and a low-temperature melt holding vessel, or (5) a low-temperature melt holding vessel furnished with a pouring ladle, and wherein the nucleating section is the holding vessel.

According to a third embodiment of the present invention which is a subembodiment of the second embodiment of present invention, the nucleating means comprises either a holding vessel tilting or inverting unit by which the angle of inclination of the holding vessel can be varied freely and automatically as required during and after pouring of the melt in accordance with its volume, or a holding vessel cooling accelerating unit capable of cooling said holding vessel externally during and after pouring of the melt, or both of said holding vessel tilting or inverting unit and said holding vessel cooling accelerating unit.

According to a fourth embodiment of the present invention which is a subembodiment of the first, the melt pouring means is a low-temperature melt pouring furnace furnished with a pouring ladle and the nucleating means comprises a vibrating jig and the holding vessel, said vibrating jig imparting vibrations to the melt as it is poured into said holding vessel which is capable of vertical movement.

According to a fifth embodiment of the present invention which is another subembodiment of the first embodiment of the present invention, the melt pouring means is a melt holding furnace furnished with a pouring ladle and the nucleating means comprises an inclining cooling jig and the holding vessel, said cooling jig being such that the angle of inclination can be varied freely and automatically during and after pouring of the melt in accordance with its volume.

According to a sixth embodiment of the present invention which is yet another subembodiment of the embodiment of the present invention, the crystal generating means comprises a vertically movable frame on which the holding vessel is placed and which is either furnished with a source for heating the bottom portion of said holding vessel or formed of an insulating material for heat-retaining said bottom portion, a vertically movable lid that is either furnished with a heating source for heating the top portion of said holding vessel or formed of an insulating material for heat-retaining said top portion and which is furnished with a temperature sensor for measuring the temperature of the melt in the holding vessel, and a cooling unit provided exterior to said holding vessel for injecting air of a specified temperature against the outer surface of said holding vessel.

According to a seventh embodiment of the present invention which is a subembodiment of the six embodiment, the crystal generating means comprises an induction apparatus furnished with a heating coil which is provided around the holding vessel for controlling the temperature of the metal in the holding vessel, a frame that is capable of heat-retaining or heating the bottom portion of the holding vessel and which is vertically movable for retaining or lifting out said holding vessel and for adjusting its position within the heating coil of the induction apparatus, a vertically movable lid that is capable of heat-retaining or heating the top portion of said holding vessel and which is furnished with a temperature sensor for measuring the temperature of the metal in the holding vessel, and a cooling unit provided exterior to said heating coil for injecting air of a specified temperature against the outer surface of said holding vessel.

According to an eighth embodiment of the present invention which is another subembodiment of the sixth embodiment, the crystal generating means comprises an induction apparatus furnished with a heating coil which is provided around the holding vessel for controlling the temperature of the metal in the holding vessel, a frame that is capable of heat-retaining or heating the bottom portion of the holding vessel and which is not only vertically movable but also rotatable for retaining, lifting out or replacing said holding vessel and for adjusting its position within the heating coil of the induction apparatus, a vertically movable lid that is capable of heat-retaining or heating the top portion of said holding vessel and which is furnished with a temperature sensor for measuring the temperature of the metal in the holding vessel, and a cooling unit provided exterior to said heating coil for injecting air of a specified temperature against the outer surface of said holding vessel. The crystal generating means comprises a plurality of units which rotate or pivot about a single axis.

According to a ninth embodiment which is yet another subembodiment of the sixth embodiment of the present invention, the crystal generating means comprises a frame that is capable of heat-retaining or heating the bottom portion of the holding vessel, a vertically movable lid that is capable of heat-retaining or heating the top portion of said holding vessel and which is furnished with a temperature sensor for measuring the temperature of the metal in the holding vessel, a cooling zone comprising a cooling unit which injects air or water of a specified temperature, as required, against the outer surface of said holding vessel, and a temperature adjusting zone having an induction apparatus furnished with a heating coil which is provided around said holding vessel for controlling the temperature of the metal in said holding vessel.

According to a tenth embodiment of the present invention which is, the crystal generating means further includes an automatic transport unit with which the holding vessel containing the metal cooled to a specified temperature in the cooling zone is moved at a specified speed to the temperature adjusting zone which is adapted to be such that either the heating coil of the induction apparatus or the holding vessel moves so that the temperature of the metal in the holding vessel is controlled within the heating coil.

According to an eleventh embodiment of the present invention which is another subembodiment of the ninth embodiment of the present invention, the crystal generating means further includes a transport unit comprising an automating device including a robot with which the holding vessel containing the metal cooled to a specified temperature in the cooling zone is moved to the temperature adjusting zone which is adapted to be such that either the heating coil of the induction apparatus or the holding vessel moves so that the temperature of the metal in the holding vessel is controlled within the heating coil.

According to a twelfth embodiment of the present invention which is an embodiment of an embodiment of first of the present invention, the holding vessel conditioning means comprises at least two of the following three units, i.e., a holding vessel cooling unit that is capable of rotary and vertical movements and which is also capable of injecting at least one of a gas, a liquid and a solid material, an air blowing unit that is capable of rotary and vertical movements and optional air injection, and a cleaning unit for cleaning the inner surfaces of the holding vessel which has a brush that is capable of rotary and vertical movements and air injection, as well as a spray unit that is capable of rotary and vertical movements and application of a nonmetallic coating, and a holding vessel rotating and transporting unit with which the holding vessel, with its opening facing down, can be moved to and fixed on the top portion of each of said cooling unit, said air blowing unit and said cleaning unit, and which is vertically movable.

According to a thirteenth embodiment of the present invention which is another subembodiment of the first embodiment of the present invention, the holding vessel conditioning means comprises a cleaning unit and a spray unit, said cleaning unit comprising a jig for cleaning the inner surfaces of the holding vessel which has a brush that is capable of rotary and vertical movements and air injection and a vertically movable jig for fixing the holding vessel, and said spray unit comprising a vertically movable jig for applying a nonmetallic coating onto the inner surfaces of the holding vessel and a vertically movable jig for fixing the holding vessel.

According to fourteenth embodiment of the present invention which is yet another subembodiment of the first embodiment of the present invention, the temperature of the holding vessel is adjusted when it is empty.

BEST MODE FOR CARRYING OUT THE INVENTION

In the present invention, a metal melted in a melting furnace is treated by either one of the following methods to generate crystal nuclei within the melt: it is directly poured into a holding vessel as a low-temperature melt that contains a specified refiner and which is held superheated to less than 50° C. above the liquidus temperature of the metal; it is poured into the holding vessel as a low-temperature melt that is held superheated to less than 50° C. above the liquidus temperature of the metal with vibrations being applied to the melt in the holding vessel as it is poured into the latter; or the melt is poured into the holding vessel as it is brought into contact with a cooling plate that can be inclined at varying angles. The melt having crystal nuclei generated therein in the crystal generating section is cooled to a temperature where a specified fraction liquid is established, with the top or bottom of the holding vessel being heat-retained or heated and with optional r-f induction heating, so that a semisolid shaping metal having a uniform temperature distribution and fine non-dendritic (spherical) primary crystals is produced not later than the start of shaping; the holding vessel is then transported by means of a robot into the injection sleeve of a molding machine such as a die-casting machine for subsequent shaping.

Figure 1:
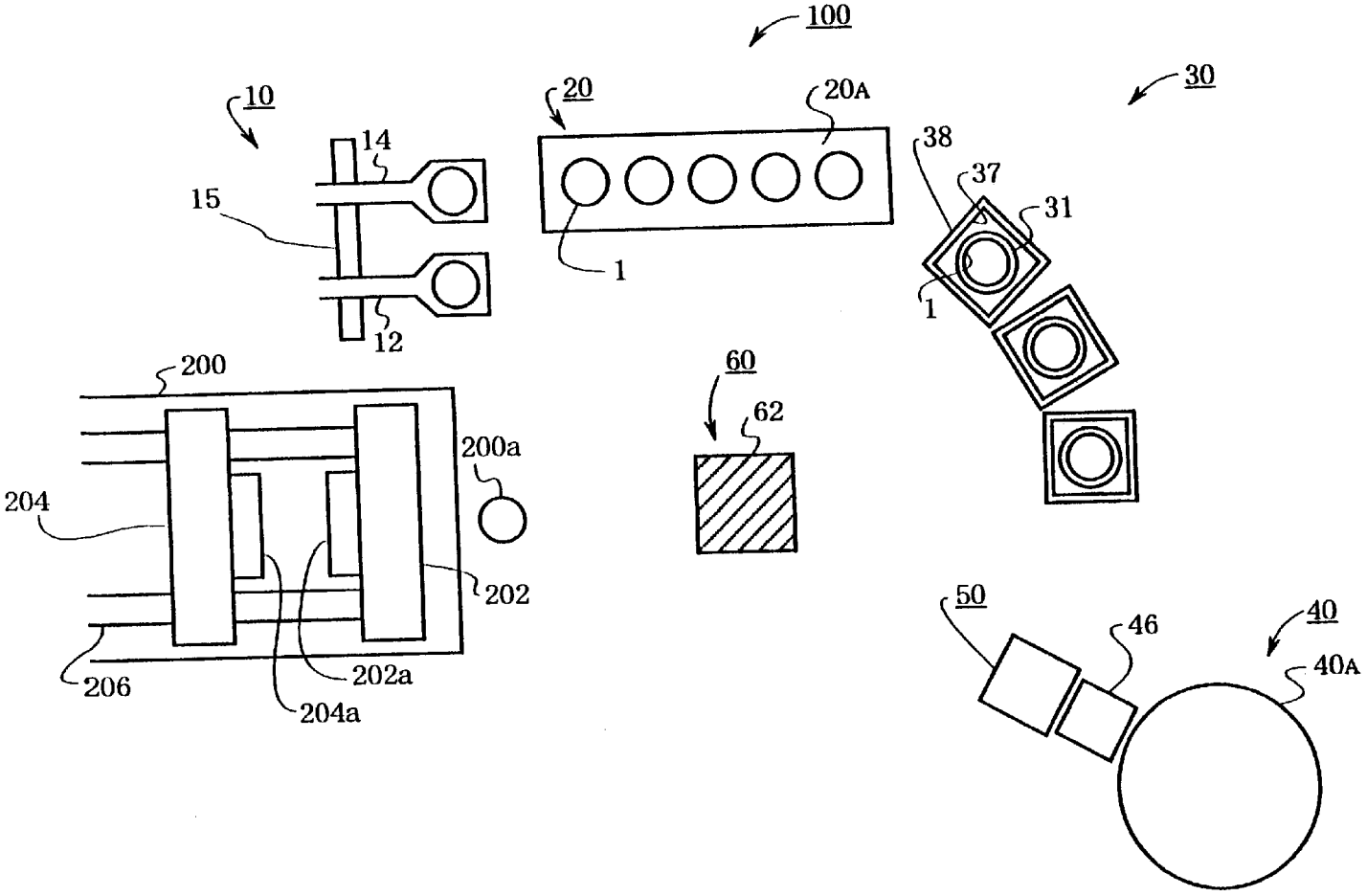
FIG. 1 is a plan view showing the general layout of the apparatus of the invention for producing a semisolid shaping metal.
Figure 2:
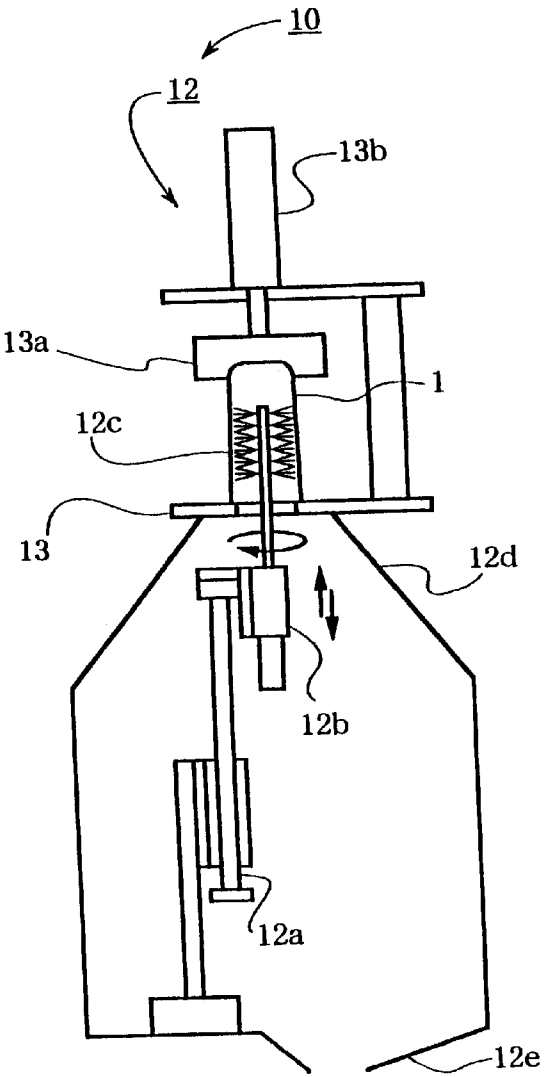
FIG. 2 is a side view of a cleaning unit in the holding vessel conditioning section of the invention apparatus.
Figure 3:
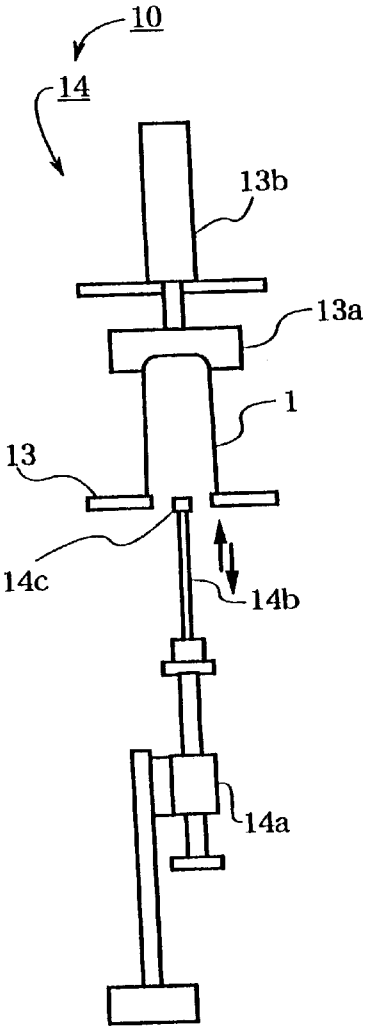
FIG. 3 is a vertical section showing enlarged the essential components of the cleaning unit.
Figure 4:
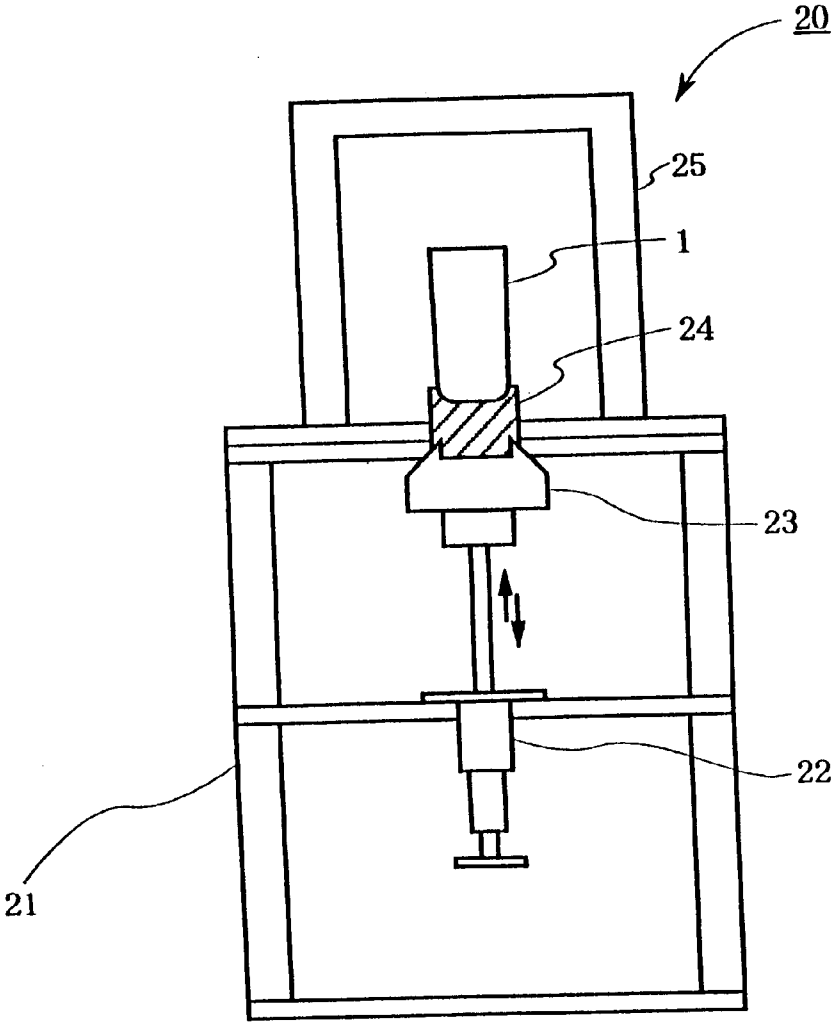
FIG. 4 is a vertical section of the holding vessel heating section of the invention apparatus.
Figure 5:
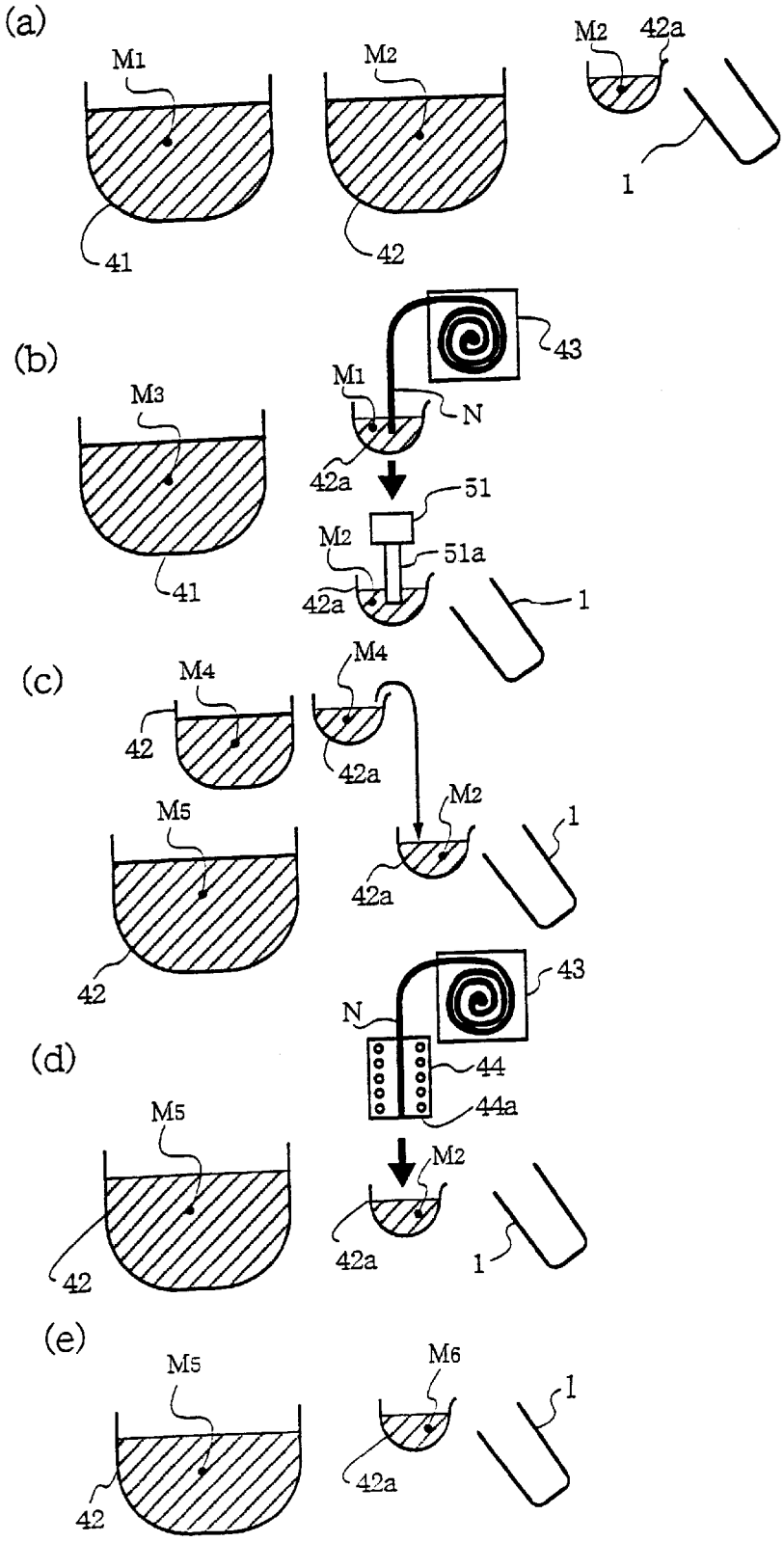
FIGS. 5*a*, 5*b*, 5*c*, 5*d* and 5*e* are schematics which the step of generating nuclei in the crystal generating section of the invention apparatus by low-temperature melt pouring techniques.
Figure 6:
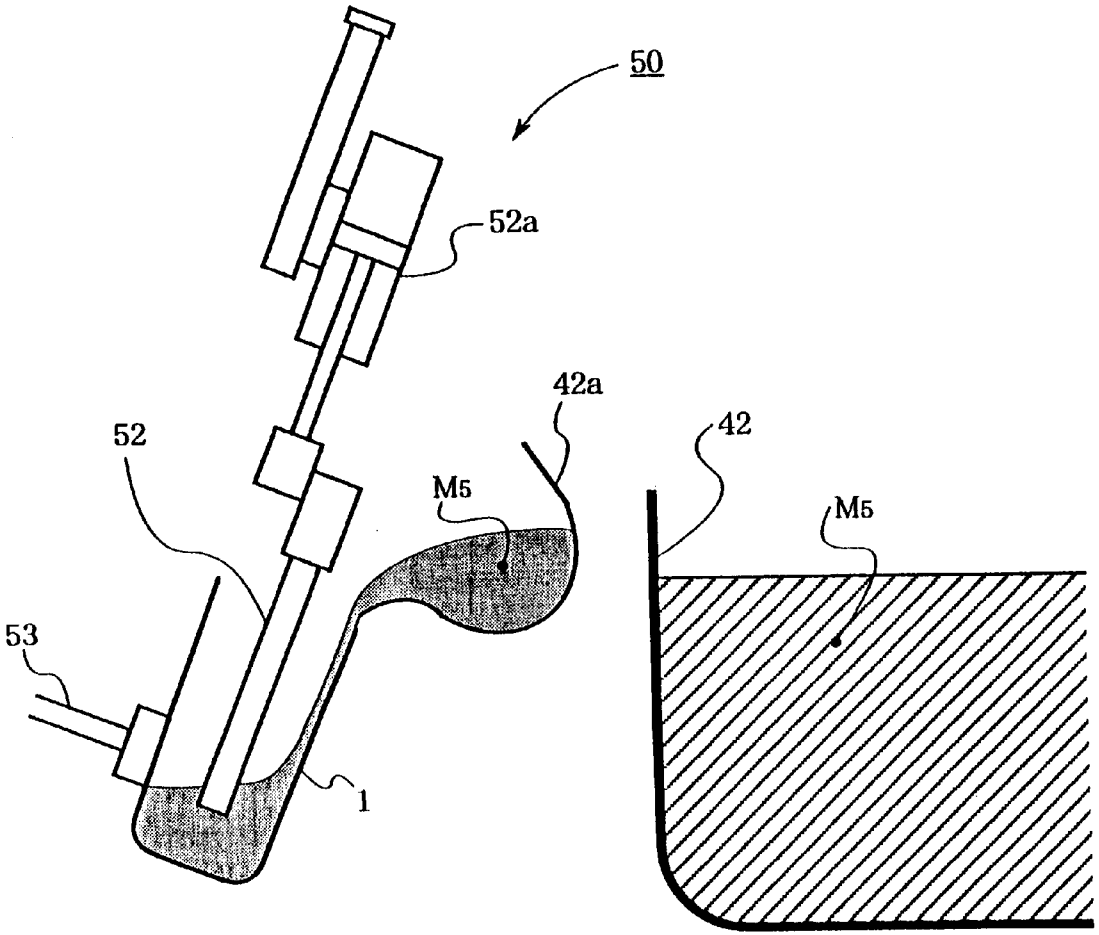
FIG. 6 illustrates the step of generating nuclei in the crystal generating section of the invention apparatus by a vibration technique.
Figure 7:
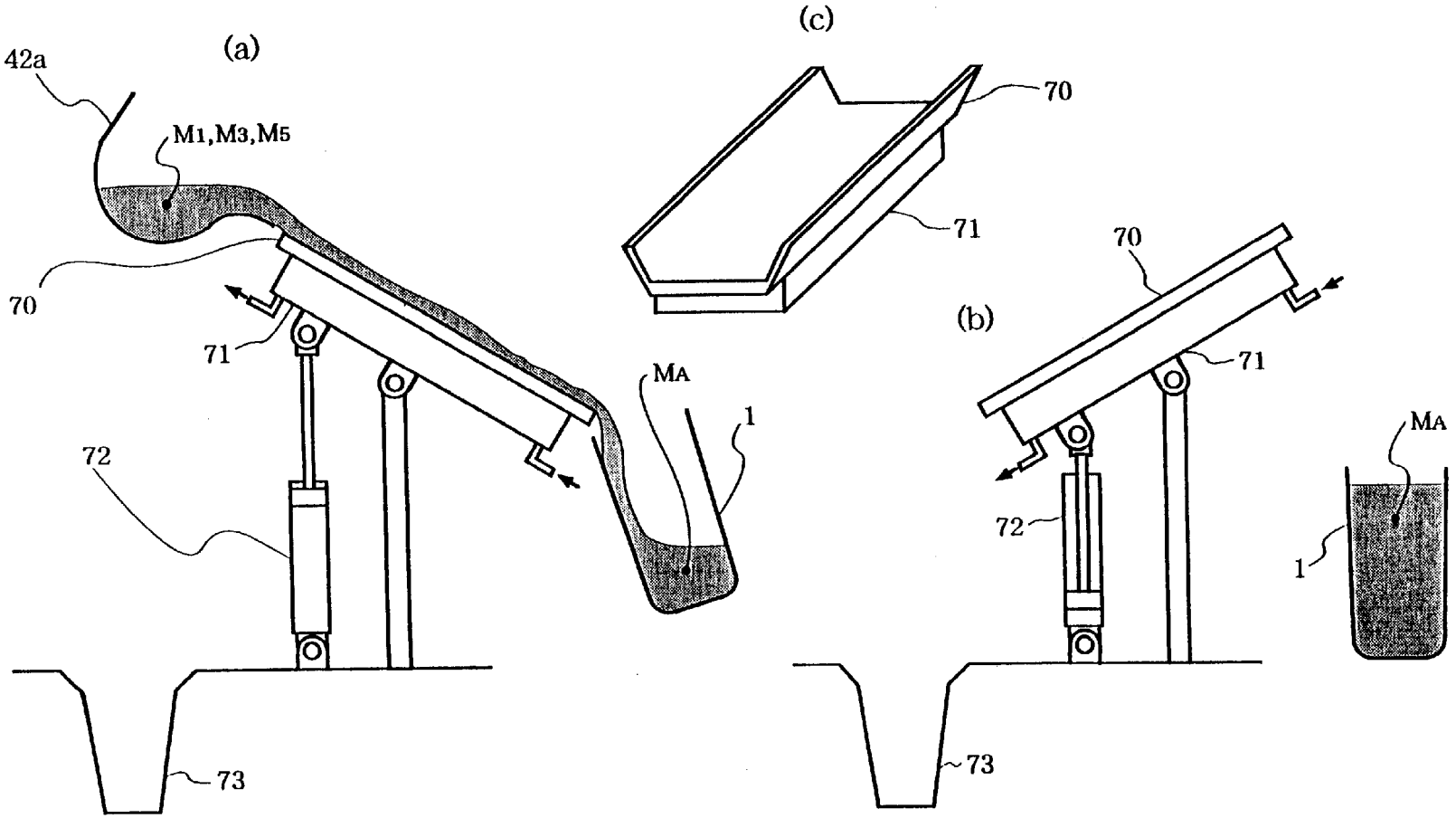
FIG. 7*a*, 7*b* and 7*c* are schematics which illustrate the step of generating nuclei in the crystal generating section of the invention apparatus by contact with a cooling plate.
Figure 8:
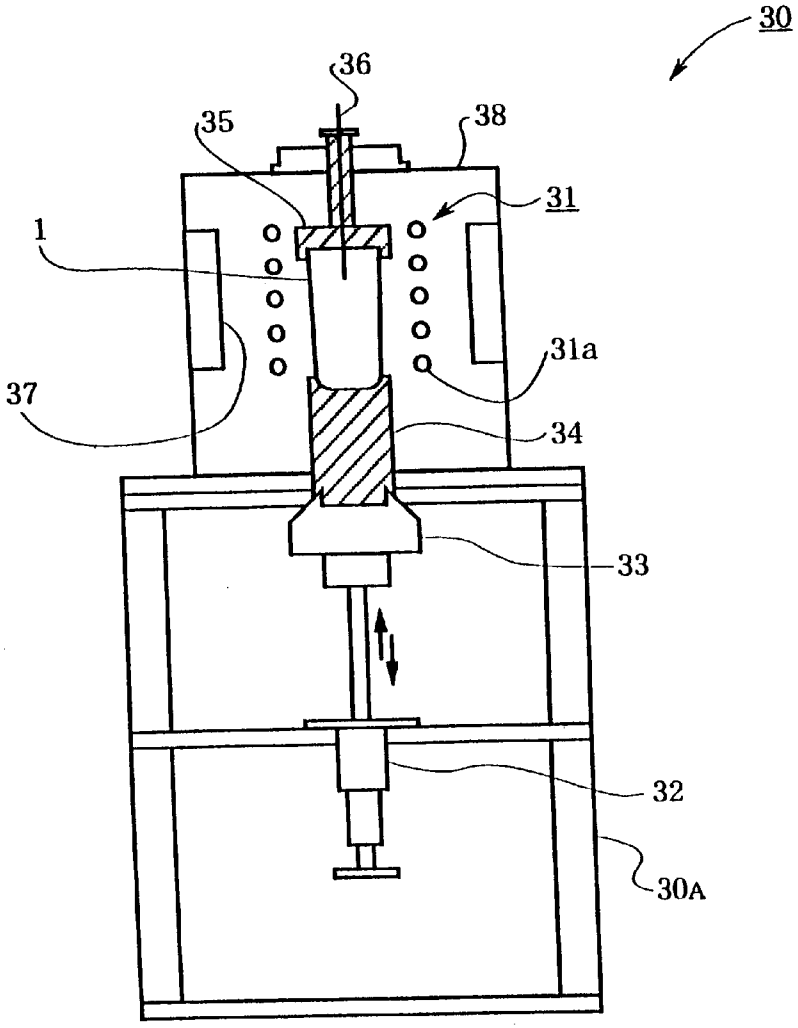
FIG. 8 is a vertical section of the crystal generating section of the invention apparatus.
Figure 9:
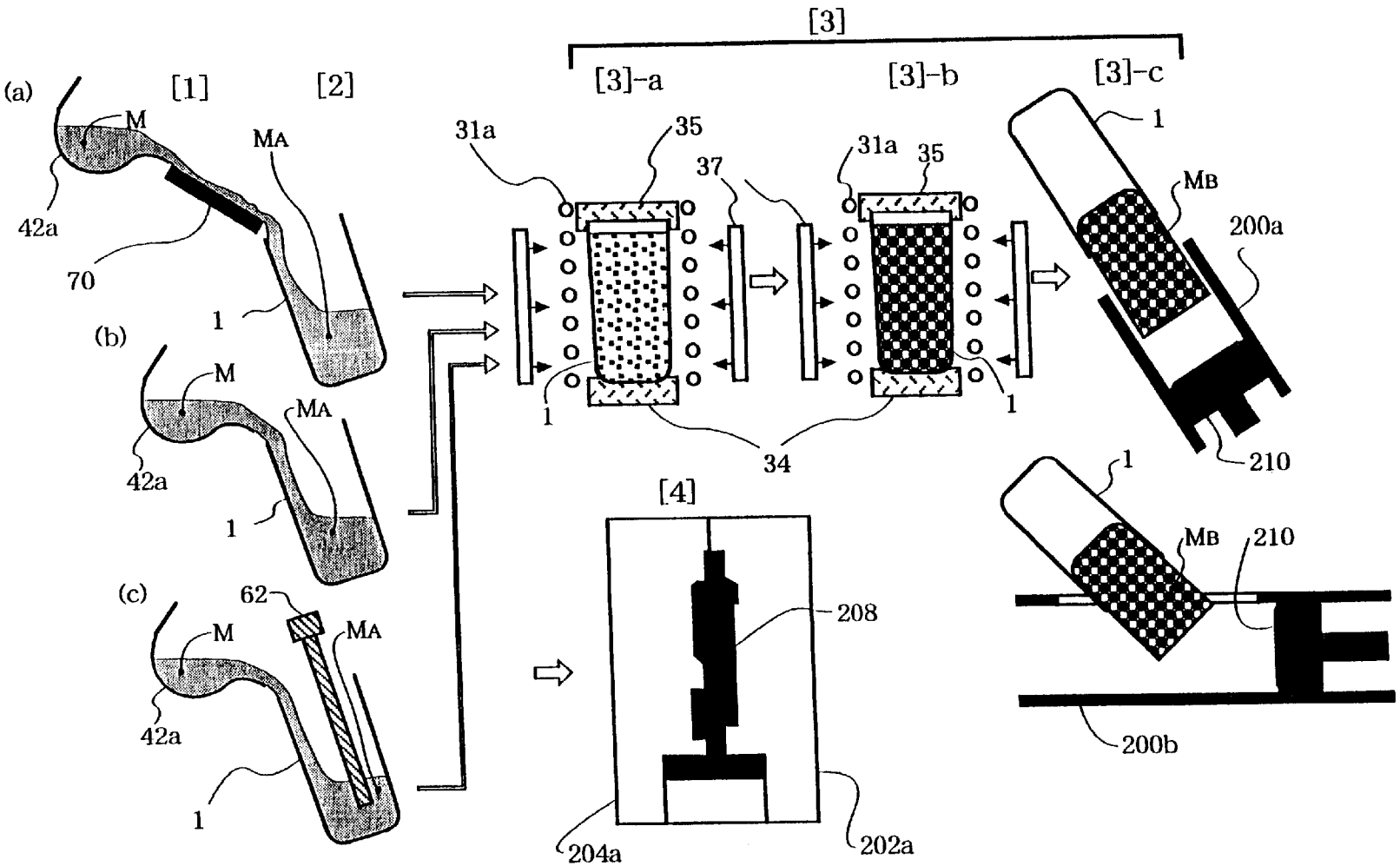
FIG. 9 is a flowsheet illustrating the process for producing a semisolid shaping metal using the apparatus of the invention.
Figure 10:
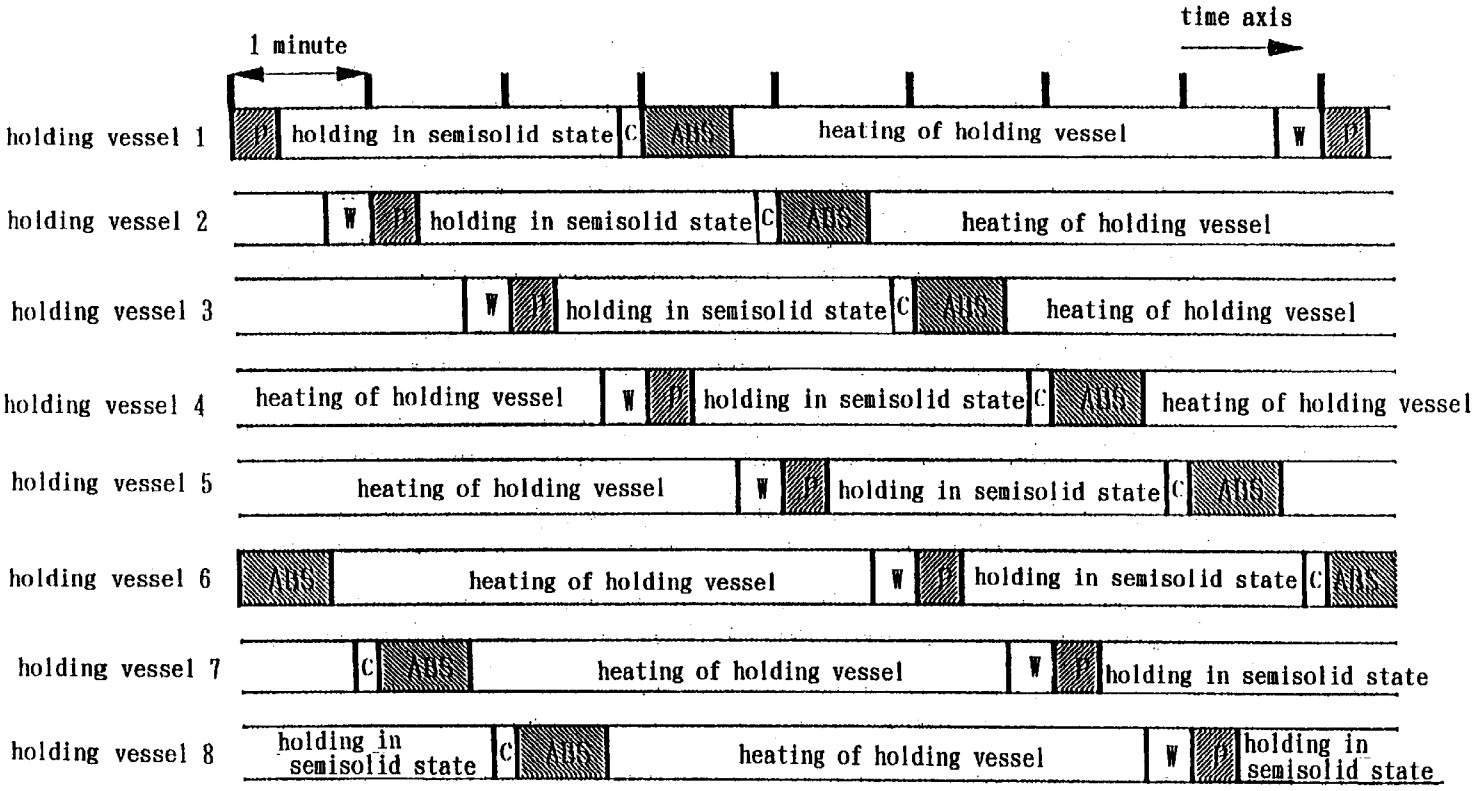
FIG. 10 is a cycle chart for the continuous semisolid shaping operation using the invention apparatus.
Figure 11:
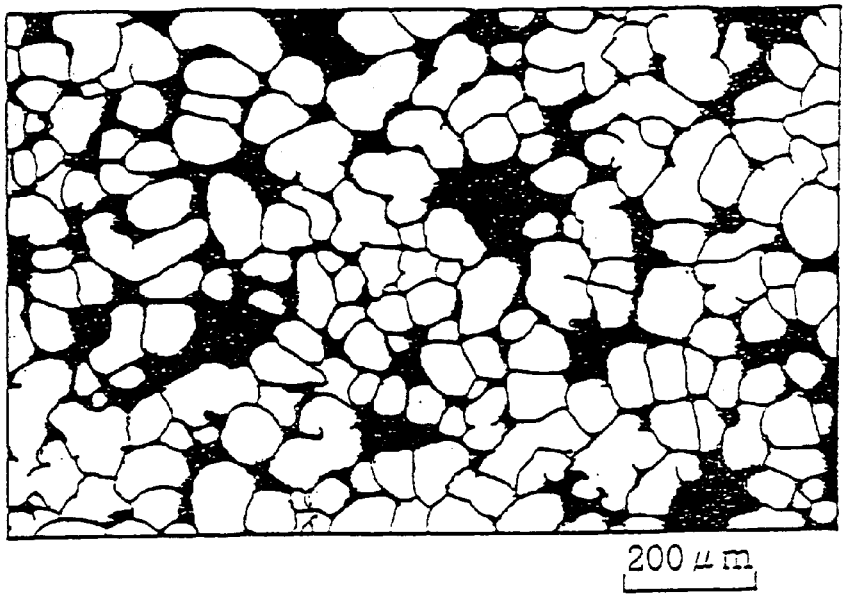
FIG. 11 is a diagrammatic representation of a micrograph showing the metallographic structure of a shaped part from the shaping metal produced by the invention.
Figure 12:
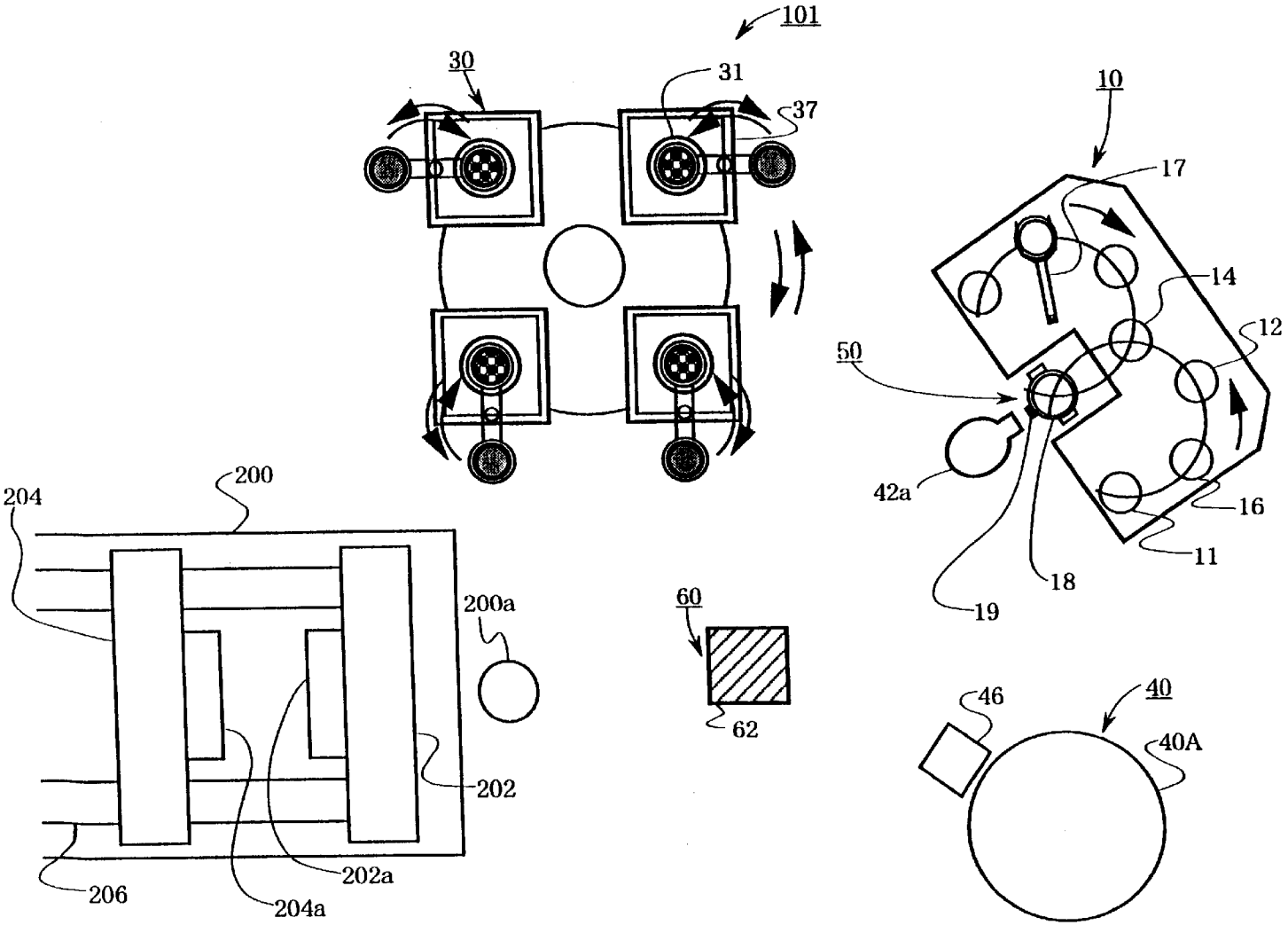
FIG. 12 is a plan view showing the general layout of an apparatus for producing a semisolid shaping metal which comprises a crystal generating means and a holding vessel conditioning means which have rotating capabilities according to the invention.
Figure 13:
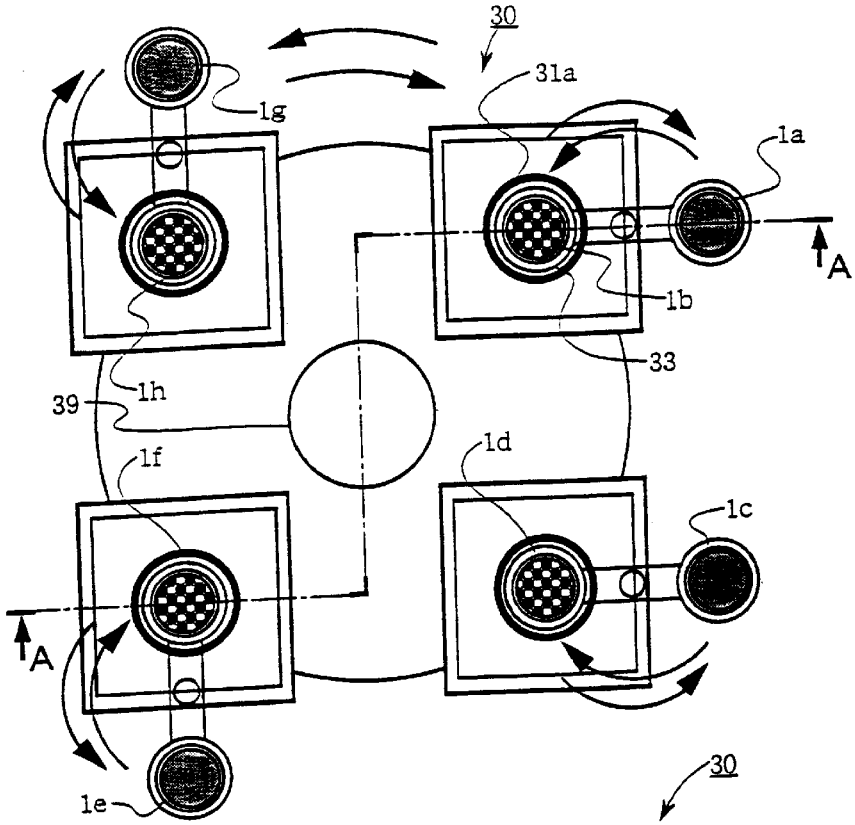
FIG. 13*a* is a plan view showing details of the crystal generating means shown in FIG. 12.
FIG. 13*b* is vertical section A—A of FIG. 13*a*.
Figure 13:
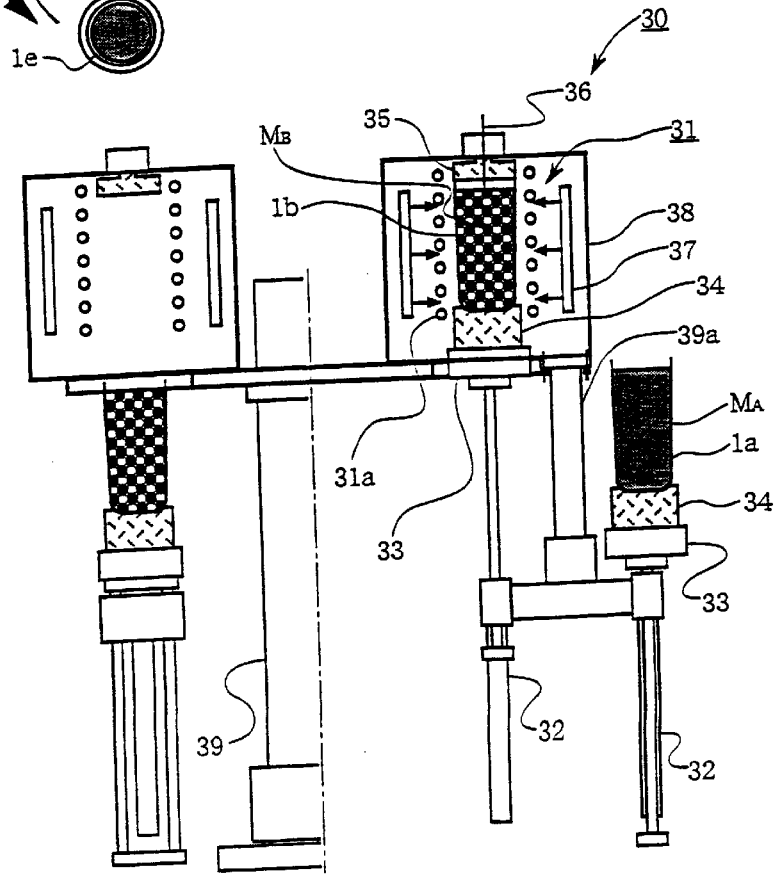
Figure 14:
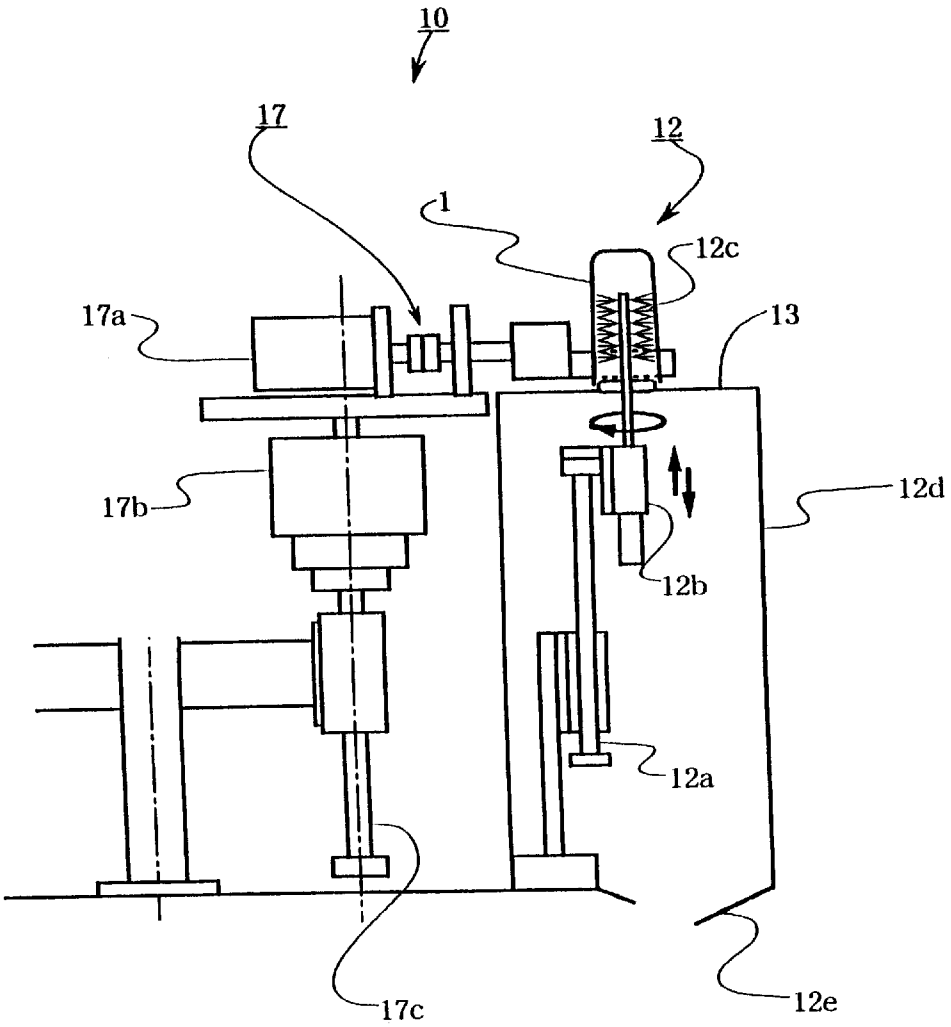
FIG. 14 is a side view of the rotating and transporting unit and the cleaning unit in the holding vessel conditioning means of the invention.
Figure 15:
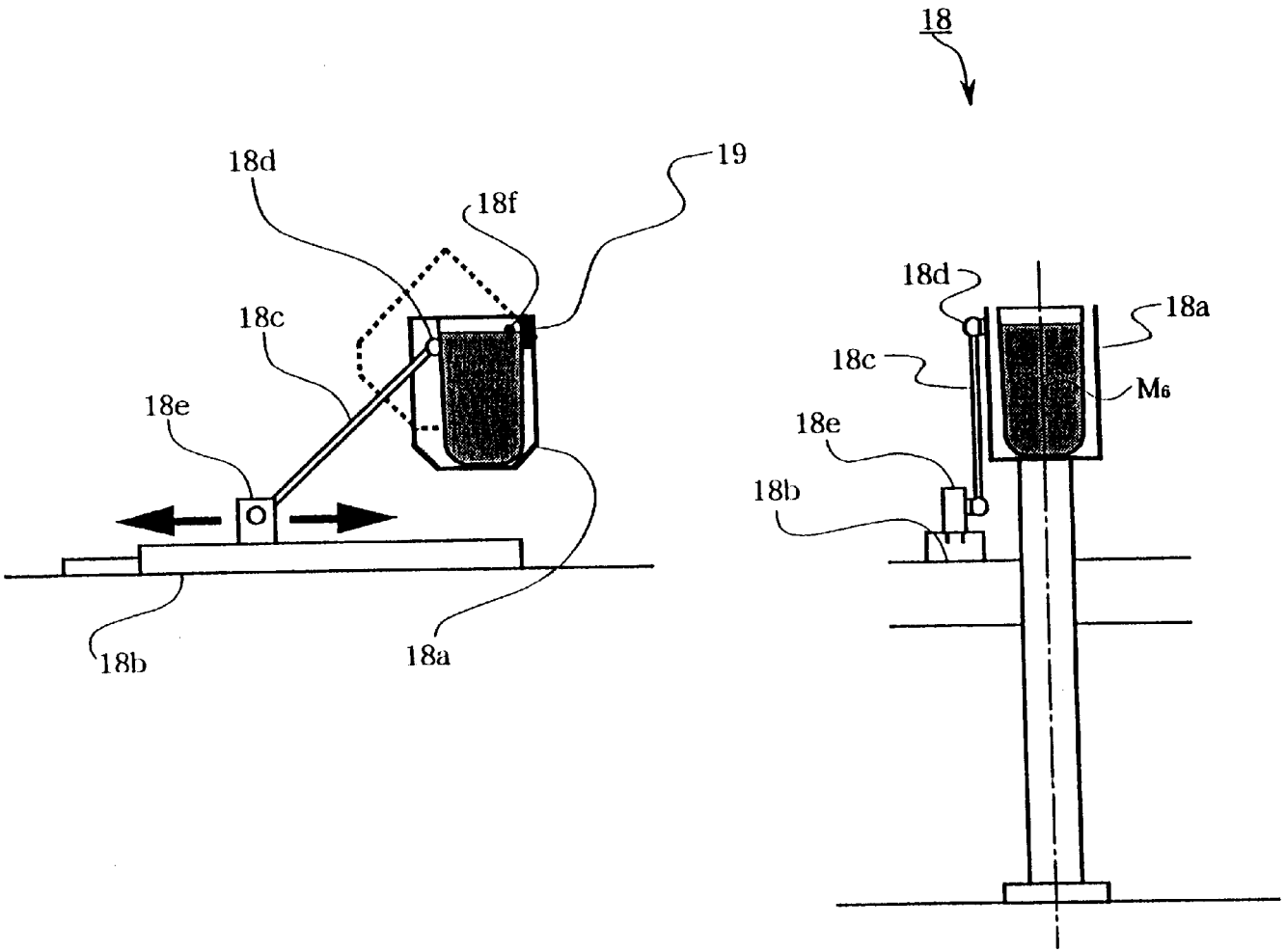
FIG. 15 is a side view of a holding vessel tilting or inverting device according to the invention.
Figure 16:
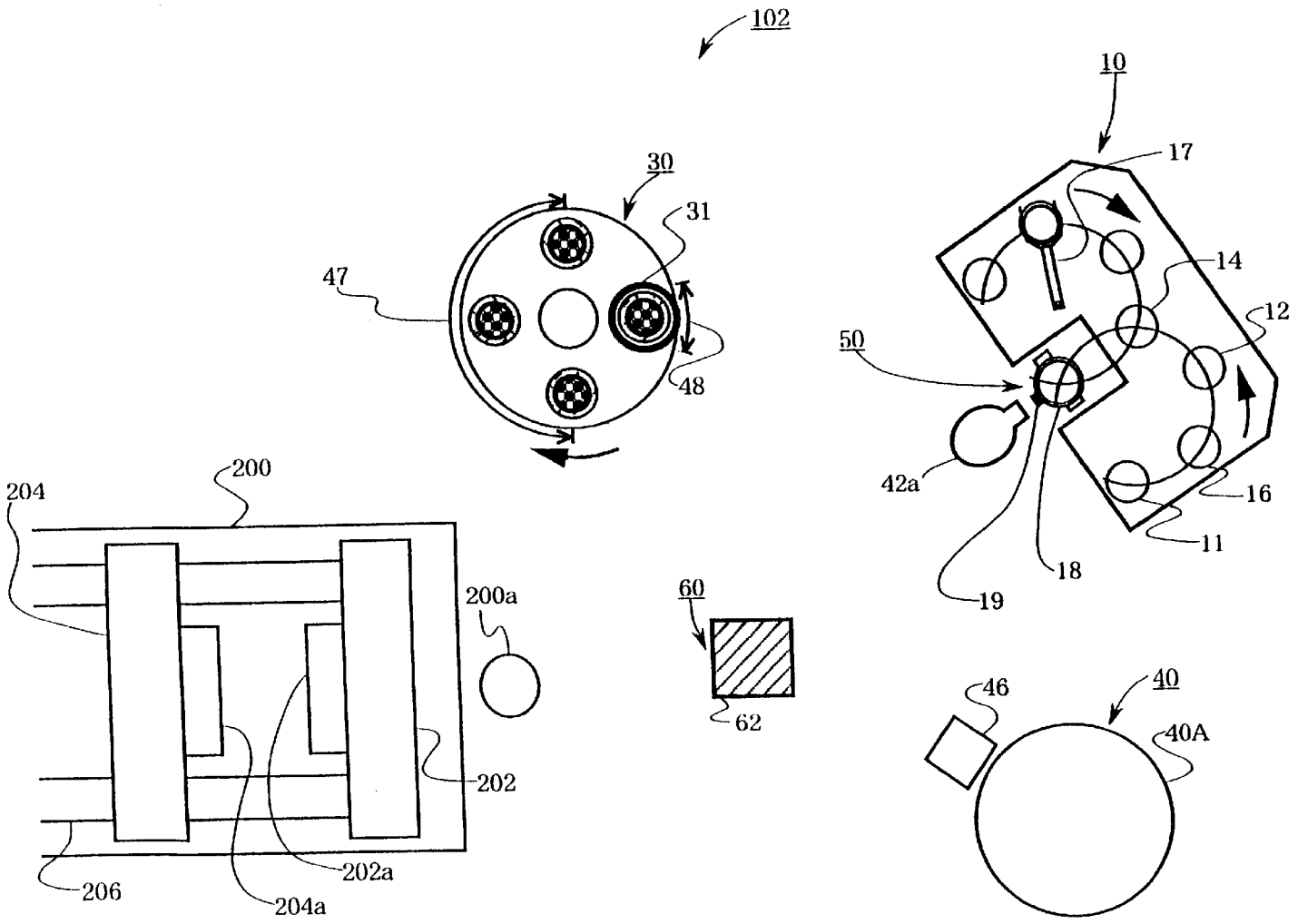
FIG. 16 is a plan view showing the general layout of an apparatus for producing a semisolid shaping metal which has a crystal generating means comprising a cooling zone and a temperature adjusting zone according to the invention.
Figure 17:
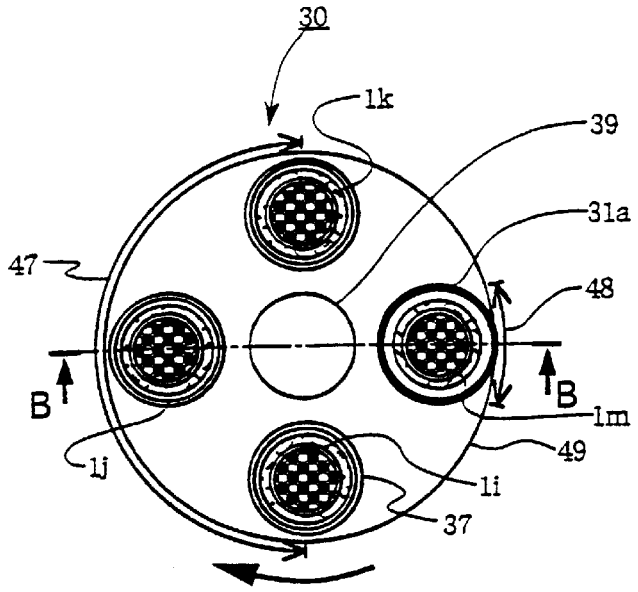
FIG. 17*a* is a plan view showing details of the crystal generating means shown in FIG. 16.
FIG. 17*b* is vertical section B—B of FIG. 17*a*.
Figure 17:
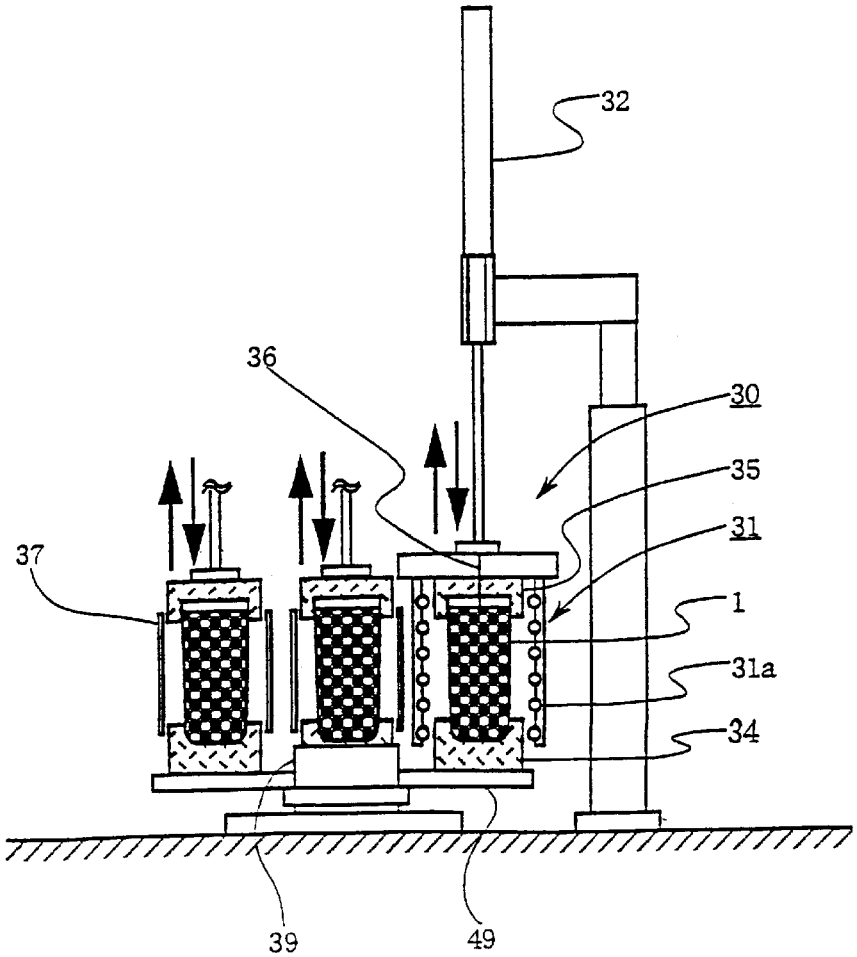
Figure 18:
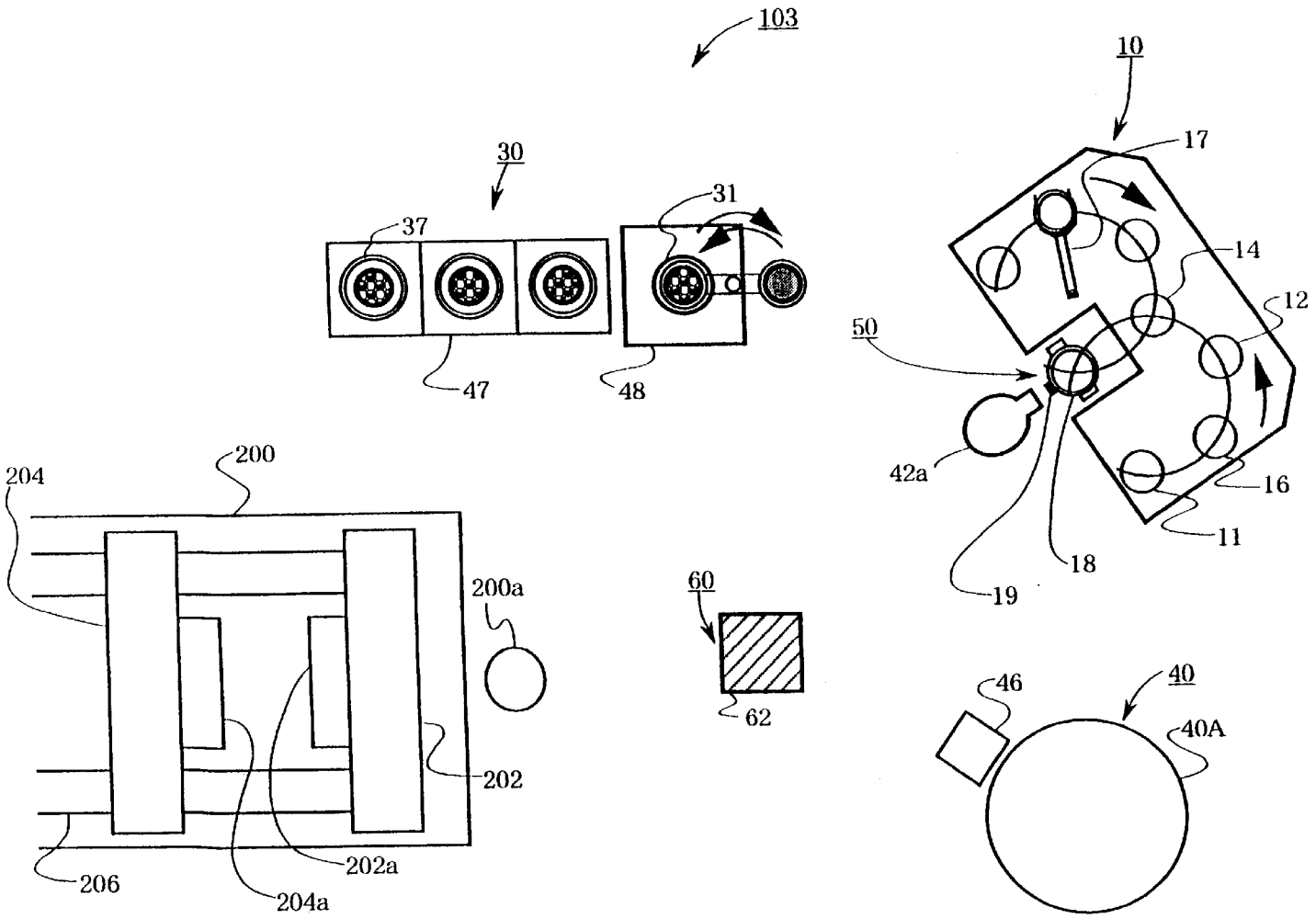
FIG. 18 is a plan view showing the general layout of an apparatus for producing a semisolid shaping metal which has a stationary crystal generating means comprising a cooling zone and a temperature adjusting zone according to the invention.
Figure 19:
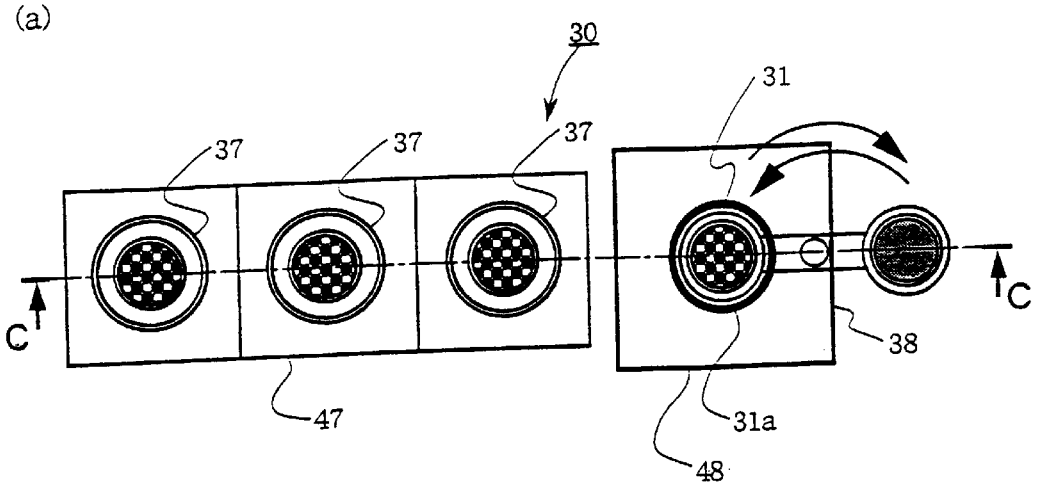
FIG. 19*a* is a plan view showing details of the crystal generating means shown in FIG. 18.
FIG. 19*b* is vertical section C—C of FIG. 19*a*.
Figure 19:
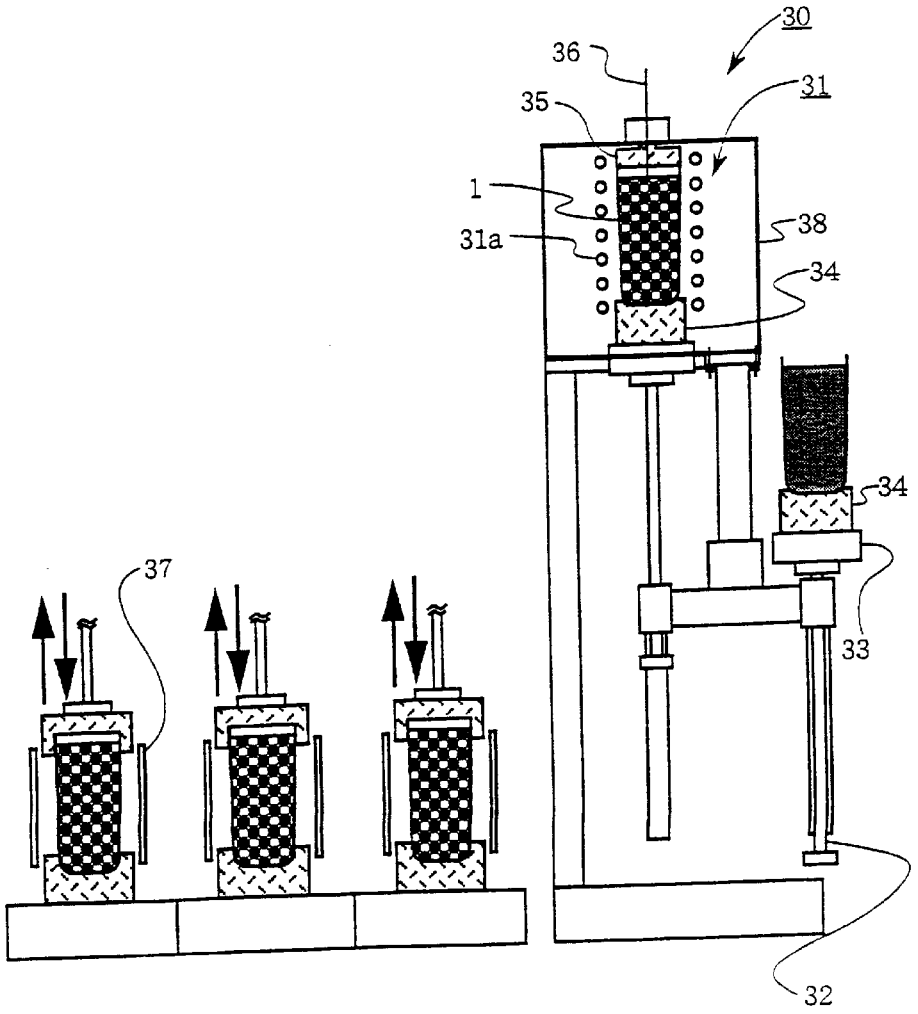

Examples of the invention will now be described in detail with reference to accompanying drawings FIGS. 1–19, in which: FIG. 1 is a plan view showing the general layout of an apparatus for producing a semisolid shaping metal; FIG. 2 is a side view of a cleaning unit in the holding vessel conditioning section of the apparatus; FIG. 3 is a vertical section showing enlarged the essential components of the cleaning unit; FIG. 4 is a vertical section of the holding vessel heating section of the apparatus; FIGS. 5*a*–5*e* illustrate the step of generating nuclei in the crystal generating section of the apparatus by low-temperature melt pouring techniques; FIG. 6 illustrates the step of generating nuclei in the crystal generating section by a vibration technique; which FIGS. 7*a–c* illustrate the step of generating nuclei in the crystal generating section by contact with a cooling plate; FIG. 8 is a vertical section of the crystal generating section; FIG. 9 is a flowsheet illustrating the process for producing a semisolid shaping metal; FIG. 10 is a cycle chart for the continuous semisolid shaping operation; FIG. 11 is a diagrammatic representation of a micrograph showing the metallographic structure of a shaped part obtained from the shaping metal produced by the invention; FIG. 12 is a plan view showing the general layout of an apparatus for producing a semisolid shaping metal which comprises a crystal generating means and a holding vessel conditioning means which have rotating capabilities; FIG. 13*a* is a plan view showing details of the crystal generating means shown in FIG. 12; FIG. 13*b* is vertical section A—A of FIG. 13*a*; FIG. 14 is a side view of the rotating and transporting unit and the cleaning unit in the holding vessel conditioning means; FIG. 15 is a side view of a holding vessel tilting or inverting device; FIG. 16 is a plan view showing the general layout of an apparatus for producing a semisolid shaping metal which has a crystal generating means comprising a cooling zone and a temperature adjusting zone; FIG. 17*a* is a plan view showing details of the crystal generating means shown in FIG. 16; FIG. 17*b* is vertical section B—B of FIG. 17*a*; FIG. 18 is a plan view showing the general layout of an apparatus for producing a semisolid shaping metal which has a stationary crystal generating means comprising a cooling zone and a temperature adjusting zone; FIG. 19*a* is a plan view showing details of the crystal generating means shown in FIG. 18; and FIG. 19*b* is vertical section C—C of FIG. 19*a*.

As FIG. 1 shows, the apparatus of the invention for producing semisolid shaping metals which is generally indicated by 100 comprises the holding vessel conditioning section 10, the holding vessel heating section 20, the crystal generating section 30, a melt pouring section 40, a nucleating section 50 and a vessel transporting section 60. A molding machine 200 is an example of the machines for shaping a semisolid metal $M_B$ produced by the invention apparatus 100.

As also shown in FIG. 1, the holding vessel conditioning section 10 comprises a cleaning unit 12 and a spray unit 14. As shown specifically in FIG. 2, the cleaning unit 12 is comprised of a vertically movable cylinder 12*a*, a motor 12*b* mounted at the distal end of the piston rod on the cylinder 12*a* and a brush 12*c* which is pushed into the holding vessel 1 by means of the motor 12*b* and rotates to inject air. After the end of melt pouring, a robot 62 in the vessel transporting section 60 which will be described later transports the holding vessel 1 into an injection sleeve 202*a*; the vessel is replaced upside down on a receiving stage 13 and a holding vessel retainer 13*a* provided just above the receiveing stage 13 is lowered gently by means of a vertically moving cylinder 13*b*, so that the bottom of the vessel 1 is lightly pressed downward until it is secured to the receiving stage.

Thereafter, the brush 12*c* going up into the vessel 1 is driven to rotate so that all of its inner surfaces including the bottom and lateral side are cleaned to dislodge the residual metal deposit on those surfaces. As shown, a closing cover 12*d* is provided downward around the receiving stage 13 and the dropping metal deposit is collected by a receiving tray 12*e*.

After the cleaning operation, the brush 12*c* is retracted downward and the receiving stage 13 and vessel retainer 13*a*, with the holding vessel 1 retained therebetween, and the vertically moving cylinder 13*b* make a lateral shift in unison from the cleaning position to the spray position (the position of the spray unit 14 indicated in FIG. 1) by means of a shift cylinder indicated by 15 in FIG. 1. As shown specifically in FIG. 3, the spray unit 14 comprises a vertically movable cylinder 14*a*, a pipe 14*b* fitted at the distal end of the piston rod on the cylinder 14*a* and a spray nozzle 14*c* at the distal end of the pipe 14*b*. A water-soluble coating containing a nonmetallic substance and air are injected through the nozzle 14*c* for a specified time so that all inner surfaces of the holding vessel 1 including the bottom and lateral side are sprayed with the coating; the applied coating is dried with air to make the inner surfaces of the holding vessel 1 cleaner.

The cleaning unit 12 and the spray unit 14 may be operated in every shot or they may be activated at regular intervals consisting of several shots. Any nonmagnetic substance that deposited on the inner surfaces of the holding vessel and which has been removed in the cleaning operations is recovered from the receiveing tray 12*e* at regular intervals of time. The spraying operation is for avoiding direct contact between the inner surfaces of the holding vessel 1 and the molten metal being poured into it and must be performed if it is made of a metal. The coating to be applied is selected from the group consisting of graphite-based mold releases, non-graphite-based mold releases (containing talc, mica, etc.) and BN.

As shown specifically in FIG. 4, the holding vessel heating section 20 comprises a cylinder frame 21, a vertically movable cylinder 22 extending up and down through the frame 21 for use in heating the holding vessel 1, support frame 23 that can be moved up and down by means of the cylinder 22, a ceramic frame 24 fixed on the support frame 23 for use in heating the holding vessel 1 and a heating furnace 25 for heating the holding vessel 1 placed on the frame 24.

After cleaning and spraying with the cleaning unit 12 and the spray unit 14, respectively, in the holding vessel conditioning section 10, the holding vessel 1 is picked up by the robot 62 and replaced on the frame 24, which then is moved up by means of the cylinder 22. When the support frame 23 and the frame 24 have ascended to the positions indicated in FIG. 4, the holding vessel 1 will enter the heating furnace 25, which is then closed off. The heating furnace 25 may have an internal heater or, alternatively, a hot blast may be blown from the outside.

After a specified time, the holding vessel 1 on the frame 24 which has been heated to a specified temperature (say, 200° C.) is taken out of the furnace by the descent of the cylinder 22. The heated holding vessel 1 is picked up by the robot 62 and transferred to the melt pouring section 40, where it is charged with a melt and thereafter transferred to the nucleating section 50. The "holding vessel" as used in the invention is a metallic or nonmetallic vessel (including a ceramic vessel), or a metallic vessel having a surface coated with nonmetalic materials, or a metallic vessel composited with nonmetallic materials. The wall thickness of the holding vessel 1 should be such that no solidified layer will form on the inner surfaces of the vessel immediately after pouring the melt or that even if a solidified layer forms, it will easily remelt upon heating with an induction heater 31 to be described later.

Each of the melt pouring section 40 and the nucleating section 50 is constructed differently depending upon the method of generating crystal nuclei. FIGS. 5*a*–5*d* are side views of the melt pouring section 40 and the nucleating section 50 for the case where nucleation is effected by pouring a low-temperature melt in the presence of a refiner.

FIG. 5*a* shows the case where the melt pouring section 40 consists of a high-temperature melt holding furnace 41 and a low-temperature melt holding furnace 42 which is furnished with a pouring ladle 42*a*. The high-temperature melt holding furnace 41 holds a high-temperature molten metal $M_1$ which has a high-melting refiner (Al—Ti—B alloy) N dissolved therein and which is held at 650° C. or above, preferably at 680° C. or above. The molten metal $M_1$ is poured from the high-temperature melt holding furnace 41 into the low-temperature melt holding furnace 42, where it is held at a lower temperature such that it is superheated to no more than 50° C. above the liquidus temperature of the metal. The resulting low-temperature melt $M_2$ is poured into the holding vessel 1 (i.e., the nucleating section 50) by means of the ladle 42*a*, whereupon crystal nuclei form in the melt. If Ti is the sole refiner in the melt, it is held superheated to no more than 30° C. above the liquidus temperature of the metal. In the case of a magnesium alloy containing both Sr and Si or containing Ca alone, the degree of superheating should be no more than 25° C. If this upper limit is exceeded, fine spherical primary crystals will not form.

FIG. 5*b* shows the case where the melt pouring section 40 consists of a pouring ladle 42*a* furnished with a refiner feed unit 43 and a temperature control cooling jig inserting device 51 and a high-temperature melt holding furnace 41. A high-temperature molten metal $M_3$ which has a refiner N (containing Ti) dissolved therein and which has been held at 650° C. or above, preferably at 680° C. or above, in the high-temperature melt holding furnace 41 is lifted out with the ladle 42*a* and supplied with an additional refiner (Al—Ti—B alloy) N from the refiner feed unit 43. Thereafter, a cooling jig 51*a* on the device 51 is submerged into the melt in the ladle 42*a* so that it is cooled to such a temperature that it is superheated to no more than 50° C. above the liquidus temperature of the metal. This yields a low-temperature molten metal. In order to prevent the formation of a solidified layer, the melt must be vibrated as the cooling jig 51*a* is submerged. However, if the temperature of the molten metal in the holding vessel 1 is such that it is superheated to at least 10° C. above the liquidus temperature of the metal, one cannot expect nuclei to be generated by vibrations. Therefore, the low-temperature melt $M_2$ in the ladle 42*a* is poured into the holding vessel 1 (i.e., the nucleating section 50), whereupon crystal nuclei are generated.

FIG. 5*c* shows the case where the melt pouring section 40 consists of a low-melt holding furnace 42 furnished with a pouring ladle 42*a* and another low-temperature melt holding furnace 42 which is also furnished with a pouring ladle 42*a* and which is capable of holding a melt rich in a refiner Al—Ti—B alloy. A Ti-containing low-temperature melt M which is lifted out of the low-temperature melt holding furnace 42 by means of the ladle 42*a* is mixed and diluted with a low-temperature melt of high Ti and B contents $M_4$ that is lifted out of the other low-temperature melt holding furnace 42 by means of the ladle 42*a*. The low-temperature melt $M_2$ in the ladle 42*a* is poured into the holding vessel 1 (i.e., the nucleating section 50), whereupon crystal nuclei are generated.

FIG. 5*d* shows the case where the melt pouring section 40 consists of a pouring ladle 42*a* furnished with a refiner melting r-f induction heater 44 and a low-temperature melt holding furnace 42. A Ti-containing low-temperature molten metal $M_5$ is lifted out of the low-temperature melt holding furnace 42 by means of the ladle 42*a*, into which a refiner (Al—Ti—B alloy) N is charged after being melted by means of a r-f induction coil 44*a*. The low-temperature melt $M_2$ in the ladle 42*a* is poured into the holding vessel 1 (i.e., the nucleating section 50), whereupon crystal nuclei are generated.

FIG. 5*e* shows the case where the melt pouring section 40 consists of a pouring ladle 42*a* and a low-temperature melt holding furnace 42. A low-temperature molten metal $M_6$ near the melting point in the holding ladle 42*a* is poured into the holding vessel 1 (i.e., the nucleating section 50), whereupon crystal nuclei are generated. If Ti is the sole refiner in the melt, it is held superheated to no more than 30° C. above the liquidus temperature of the metal.

FIG. 6 is a side view of the melt pouring section 40 and the nucleating section 50 for the case of generating nuclei by applying vibrations. The melt pouring section 40 consists of the low-temperature melt holding furnace 42 furnished with the pouring ladle 42*a*, a submergible vibrating jig 52 that can be moved up and down by means of a vertically moving cylinder 52*a*, and a jig 53 for vibrating the holding vessel 1. To generate crystal nuclei in the Ti-containing low-temperature molten metal $M_5$ being poured into the holding vessel 1 from the ladle 42*a*, vibrations are applied by the following two methods: submerging the vibrating jig 52 into the surface of the melt $M_5$ and placing the vibrating jig 53 into contact with the outer surface of the holding vessel 1. It should be mentioned that crystal nuclei can be generated even if no refiners are contained in the melt being poured into the holding vessel 1. In order to ensure that there will be no uneven temperature distribution about it, the submerged vibrating jig 52 should be disengaged from the surface of the melt as soon as the pouring step has ended. The term "vibration" as used herein is in no way limited in terms of the type of the vibrator used and the vibrating conditions (frequency and amplitude) and any commercial pneumatic and electric vibrators may be employed. As for the applicable vibrating conditions, the frequency typically ranges from 10 Hz to 50 kHz, preferably from 50 Hz to 1 kHz, and the amplitude ranges from 1 mm to 0.1 $\mu$m, preferably from 500 $\mu$m to 10 $\mu$m, per side.

FIG. 7 is a side view of the melt pouring section 40 and the nucleating section 50 for the case of generating nuclei by contact with a cooling plate. The melt pouring section 40 consists of a melt holding furnace assembly 40A (comprising a high-temperature melt holding furnace 41 and a low-temperature melt holding furnace 42) furnished with a pouring ladle 42*a*. The temperature of the melt in the melt holding furnace assembly 40A is not limited to any particular value; however, if its temperature is unduly high, it will become superheated to at least 10° C. above the liquidus temperature of the metal after it has passed over an inclining cooling jig 70 and no crystal nuclei will be formed. Therefore, the melt in the holding furnace assembly 40A is preferably superheated to no more than 50° C. above the liquidus temperature of the metal. The nucleating section 50 consists of the inclining cooling jig 70 and the holding vessel 1. The cooling jig 70 has a water tank 71 that is freely and automatically adjustable during and after pouring of the melt in accordance with the angle of inclination of the jig 70 and the pour volume of the melt. As the volume of the molten metal that is poured from the ladle 42*a* into the holding vessel 1 while making contact with the inclined cooling jig 70 approaches the upper limit, the angle of inclination of the jig 70 is reduced by means of a vertically movable cylinder 72. After the end of the pouring of the melt, the cooling jig 70 is inclined in opposite direction so that the metal deposit on the surface of the jig 70 drops into a metal deposit recovery tank 73.

In the cases described above, the melt pouring section 40 uses the pouring ladle 42 but this may be replaced by a pouring pump.

FIG. 8 shows the details of the crystal generating section 30. As shown, it comprises an induction heater 31 furnished with a heating coil 31*a* which is provided around the holding vessel 1 for controlling the temperature of the metal in it, a vertically movable cylinder 32, a support frame 33 that can be moved up and down by means of the cylinder 32 for retaining or lifting out the holding vessel 1 and for adjusting its position within the heating coil 31*a*, ceramic frame 34 placed on the support frame 33, a ceramic lid 35 capable of heat-retaining or heating the top of the holding vessel 1 and which is furnished with a thermocouple 36 for measuring the temperature of the metal in the holding vessel 1, a cooling unit 37 which is provided exterior to the heating coil 31*a* for injecting air of a specified temperature against the outer surface of the holding vessel 1, and a protective cover 38 surrounding the induction heater 31, frame 34, lid 35 and cooling unit 37.

The induction heater 31 is effective for providing a uniform temperature distribution and ensuring a constant temperature after the temperature of the metal in the holding vessel has been lowered rapidly or when a trouble occurs to the molding machine 200. If it is necessary to cool the metal faster than when it is cooled with air, the cooling unit which injects air may be replaced by a device which sprays the holding vessel 1 with water before it ascends to the position where the induction heater 31 is provided.

After being charged with the molten metal $M_A$ into which crystal nuclei have been introduced in the nucleating section 50, the holding vessel 1 is picked up by the robot 62 and replaced on the ceramic frame 34, which then is moved up by means of the cylinder 32 until it stops at a specified position in the induction heater 31. Thereafter, the ceramic lid 35 is placed on top of the holding vessel 1 and fixed in position. Subsequently, air is blown from the cooling unit 37 against the outer surface of the holding vessel 1 for a specified period of time at a specified timing, both being determined by a specific need, such that the molten metal $M_A$ within the holding vessel 1 is cooled at an average rate of 0.01° C./s–3.0° C./s from the temperature right after the pouring of the melt until just before the start of the molding step, thereby generating fine primary crystals within the alloy solution; at the same time, temperature adjustment is effected by means of the induction heater 31 such that the temperatures of various parts of the semisolid metal $M_B$ in the holding vessel 1 will fall within the desired molding temperature range for establishment of a specified fraction liquid not later than the start of the molding step. To enable temperature control of the semisolid metal $M_B$, the ceramic frame 34 is so designed that it can be finely adjusted automatically to a desired height within the heating coil 31*a*.

If it is not critical that the semisolid metal $M_B$ be maintained at a constant temperature before molding, there may be a case where the induction heater 31 need not be operated.

When the semisolid metal $M_B$ in the holding vessel 1 on the ceramic frame 34 has been held for a specified time at a specified fraction liquid, the cylinder 32 is lowered so that the holding vessel 1 is taken out of the induction heater 31, picked up by the transport robot 62 and immediately inserted into the injection sleeve 200*a* which is of a vertical type (or a horizontal type 200*b*) in the molding machine 200.

The term "a specified fraction liquid" means a relative proportion of the liquid phase which is suitable for pressure forming. In high-pressure casting operations such as die casting and squeeze casting, the fraction liquid is less than 75%, preferably in the range of 40%–65%. If the fraction liquid is less than 40%, not only is it difficult to recover the alloy from the holding vessel 1 but also the formability of the raw material is poor. If the fraction liquid exceeds 75%, the raw material is so soft that it is not only difficult to handle but also less likely to produce a homogeneous microstructure because the molten metal will entrap the surrounding air when it is inserted into the sleeve for injection into a mold on a diecasting machine or segregation develops in the metallographic structure of the casting. For these reasons, the fraction liquid for high-pressure casting operations should not be more than 75%, preferably not more than 65%. However, in the case of alloys that have low shaping and flowing properties or to yield products that are difficult to shape, it is sometimes desirable to perform the shaping operation with a fraction liquid higher than 75%. In this case, a semisolid metal having a fraction liquid higher than 75% may be poured from the holding vessel into the sleeve.

In extruding and forging operations, the fraction liquid ranges from 1.0% to 70%, preferably from 10% to 65%. Beyond 70%, an uneven structure can potentially occur. Therefore, the fraction liquid should not be higher than 70%, preferably 65% or less. Below 1.0%, the resistance to deformation is unduly high; therefore, the fraction liquid should be at least 1.0%. If extruding or forging operations are to be performed with an alloy having a fraction liquid of less than 40%, the alloy is first adjusted to a fraction liquid of 40% and more before it is taken out of the holding vessel and thereafter the fraction liquid is lowered to less than 40%.

The robot 62 in the vessel transporting section 60 is a known multi-joint robot capable of three-dimensional movements. The robot may be automated by means of a programmable personal computer or sequencer of a programmable controller.

According to the invention, semisolid metal forming will proceed by the following specific procedure. In step (1) of the process shown in FIG. 9, a complete liquid form of metal M is contained in the ladle 42*a*. In step (2), the metal M is poured into the holding vessel 1 (which may be a ceramic-coated metallic vessel) as it is contacted by the inclined cooling jig 70 [see step (I-a)], or with the melt being held superheated to less than 50° C., preferably less than 30° C., above the liquidus temperature of the metal [see step (I-b)], or with the vibrating jig 52 (specifically, vibrating rod 52A) being submerged in the melt to impart vibrations as it is progressively poured into the holding vessel 1 [see step (I-c)]. As a result, there is obtained an alloy that contains crystal nuclei (or fine crystals) either just above or below the liquidus temperature of the metal.

In subsequent step (3), the alloy is cooled at an average rate of 0.01° C./s–3.0° C./s and held as such within the holding vessel 1 until just prior to the start of shaping under pressure so that fine primary crystals are generated in said alloy solution; at the same time, temperature adjustment is effected with the induction heater 31 such that the temperatures of various parts of the alloy in the vessel 1 will fall within the desired molding temperature range (±5° C. of the desired molding temperature) for establishment of a specified fraction liquid not later than the start of the molding step. In this case, a specified amount of electric current is applied before the representative temperature of the metal slowly cooling in the holding vessel 1 from the temperature right after the start of melt pouring has dropped to at least 10° C. below the desired molding temperature and, hence, the induction heater 31 needs to produce a comparatively small output power. For cooling the alloy, air is blown against the holding vessel 1 from its outside. If necessary, both the top and bottom portions of the holding vessel 1 may be heat-retained with a heat insulator or heated so that the alloy is held partially molten to generate fine spherical (non-dendritic) primary crystals from the introduced crystal nuclei [see step (3-a) and (3-b)].

Metal $M_B$ thus obtained at a specified fraction liquid is inserted from the inverted holding vessel 1 [see step (3-c)] into the injection sleeve 200*a* of the molding machine (e.g. die casting machine) 200 and thereafter pressure formed within the mold cavity 208 on the molding machine to produce a shaped part. In order to ensure that the semisolid metal $M_B$ being discharged from the inverted vessel will not be contaminated by oxides, it is necessary that the surface portion of the metal which was situated in the top of the vessel 1 should face a plunger tip 210.

FIG. 10 is a cycle chart for the continuous semisolid shaping operation. To facilitate explanation, the chart assumes the use of a small number of induction heaters which are each operated for 60 seconds. The general layout of the production apparatus 100 is shown in FIG. 1. The specific operating conditions were as follow.

(1) Induction heater: Three units (8 kHz, 10 kW)

(2) Holding vessel: One unit heating furnace (accommodating five vessels)

(3) Molding cycle Sixty seconds (4) Melt pouring and: Refiner (containing 0.15% Ti nucleating conditions and 0.002% B); melt poured into holding vessel at 635° C.; See FIG. 5*a*.

(5) Time of holding metal: 150 seconds partially molten under air cooling and r-f induction heating (6) Alloy: AC4CH (m.p. 615° C.)

The time course in each step of the semisolid shaping process is shown in FIG. 10 for each of the 8 holding vessels used. Obviously,casting is performed at 60-sec intervals. FIG. 10 also shows the position of the holding vessel before and after the casting, as well as the operations performed at those times. The semisolid shaping metal produced by the process was shaped under pressure and a diagrammatic representation of a micrograph showing the metallographic structure of the shaped part is given in FIG. 11, from which one can see that the shaped part according to the invention has a fine structure which is by no means inferior to that of the best semisolid shaped product ever known.

The obvious differences the invention process has from the conventional thixocasting and rheocasting methods are clear from FIG. 9. In the invention method, the dendritic primary crystals that have been generated within a temperature range of from the semisolid state are not ground into spherical grains by mechanical or electromagnetic agitation as in the prior art but the large number of primary crystals that have been generated and grown from the introduced crystal nuclei with the decreasing temperature in the range for the semisolid state are spheroidized continuously by the heat of the alloy itself (which may optionally be supplied with external heat and held at a desired temperature). In addition, the semisolid metal forming method of the invention is characterized by the production of a uniform microstructure and temperature distribution by r-f induction heating with lower output and it is a very convenient and economical process since it does not involve the step of partially melting billets by reheating in the thixo-casting process.

FIG. 12 is a plan view showing the general layout of an apparatus for producing a semisolid shaping metal which is indicated by 101 and which comprises a crystal generating section 30 and a holding vessel conditioning section 10 which have rotating capabilities. The apparatus 101 comprises the holding vessel conditioning section 10, the crystal generating section 30, a melt pouring section 40, a nucleating section 50 and a vessel transporting section 60. A shaping apparatus indicated by 200 in FIG. 12 is an example of the machine for shaping a semisolid metal $M_B$ produced with the apparatus 101 of the invention.

The holding vessel conditioning section 10 comprises a holding vessel cooling unit 11, an air blowing unit 16, a cleaning unit 12, a spray unit 14 and a holding vessel rotating and transporting unit 17. The holding vessel rotating and transporting unit 17 and the cleaning unit 12 in the holding vessel conditioning section 10 are shown specifically in FIG. 14. The holding vessel rotating and transporting unit 17 is composed of rotary actuators 17*a* and 17*b* and a vertically moving cylinder 17*c*. After inserting the semisolid metal $M_B$ into the injection sleeve 200*a*, water and air are successively injected into the holding vessel 1 by means of a device which, as shown in FIG. 3, has a cylinder and a motor-driven vertically moving and rotating nozzle; the thus cooled and air-blown holding vessel 1 is transported by means of the unit 17 and lowered to rest on the receiveing stage 13 and fixed in position. Thereafter, as shown in FIG. 2, the brush 12*c* is rotated to clean the inner surfaces of the holding vessel 1. After the brush 12*c* is lowered, the unit 17 as it keeps retaining the holding vessel 1 is raised and moved to the position of the spray unit 14. Thereafter, as shown in FIG. 3, a watersoluble coating containing a nonmetallic substance is injected from the spray unit 14 so that the inner surfaces of the holding vessel 1 are sprayed with the coating, and the applied coating is dried with air.

After the spray unit is lowered, the holding vessel 1 is moved to the position of a holding vessel tilting or inverting device 18, where it is turned upside down and replaced within a holding vessel holder indicated by 18*a* in FIG. 15. The holding vessel tilting or inverting device 18 comprises an LM guide 18*b*, a linking rod 18*c* and a flexible joint 18*d*. The holding vessel holder 18*a* is allowed to tilt by means of the device 18 in accordance with the pouring of the melt from the pouring ladle 42*a*. The molten metal $M_6$ which contains Ti as the sole refiner and which should be held superheated to no more than 30° C. above the liquidus temperature of the metal is poured in using a holding vessel cooling accelerating unit 19 as required. The molten metal $M_6$ poured into the holding vessel 1 is transported to the crystal generating section 30 by means of a robot 62. Thereafter, the molten metal $M_6$ is cooled down to a shaping temperature. The holding vessel cooling accelerating unit 19 may be such that it injects air or water directly against the outer surface of the holding vessel or, alternatively, a chilling member may be brought into contact with the holding vessel.

FIG. 13*a* is a plan view showing details of the crystal generating section of the apparatus shown in FIG. 12 for producing a semisolid shaping metal, and FIG. 13*b* is vertical section A—A of FIG. 13*a*. As shown in FIGS. 13*a* and 13*b*, the crystal generating section 30 comprises an induction apparatus 31 furnished with a heating coil 31*a* which is provided around the holding vessel 1 for controlling the temperature of the metal in the holding vessel 1, a ceramic frame 34 that is capable of heat-retaining or heating the holding vessel 1 and which is placed on a vertically movable support table 33 for retaining or lifting out said holding vessel 1 or replacing it by means of a secondary rotating shaft 39*a* (i.e., replacement of a holding vessel of molten metal $M_A$ containing crystal nuclei with a holding vessel of semisolid metal $M_B$ which has been cooled to the shaping temperature) and for adjusting the position of the holding vessel 1 within the heating coil 31*a* of the induction apparatus 31, a vertically movable lid 35 that is capable of heat-retaining or heating the top portion of the holding vessel 1 and which is furnished with a thermocouple 36 for measuring the temperature of the metal in the holding vessel 1, a cooling unit 37 provided exterior to the heating coil 31*a* for injecting air of a specified temperature against the outer surface of the holding vessel 1, a protective cover 38 surrounding the above-mentioned components, and a primary rotating shaft 39 on which four units of the crystal generating section can rotate or pivot.

When the holding vessel 1*a* of molten metal $M_A$ containing crystal nuclei is placed on the ceramic frame 34 on the support table 33, the holding vessel 1*b* of semisolid metal $M_B$ which has been adjusted to the shaping temperature within the induction apparatus 31 is lowered by means of a vertically moving cylinder and then rotated by the secondary rotating shaft 39*a* to be situated outside the crystal generating section 30. At the same time, the holding vessel 1*a* of molten metal $M_A$ is raised by a vertically moving cylinder 32 to a specified position in the heating coil 31*a* of the induction apparatus 31, where the metal $M_A$ is cooled to a specified temperature by means of the cooling unit 37 and its temperature is subsequently adjusted by the induction apparatus 31. Other units of the holding vessel 1 are subjected to the same sequence of actions as described above. The holding vessel 1*b* of semisolid metal $M_B$ which has thusly become situated outside the crystal generating section 30 is subsequently transported by the robot 62. Holding vessels 1*e*/1*f* and 1*g*/1*h* which are situated far from the robot are pivoted (rotated through 90 degrees) by means of the primary rotating shaft 39 to move to the positions of holding vessels 1*c*/1*d* and 1*a*/1*b*, respectively.

The function of the induction apparatus 31, as well as the conditions for cooling molten metal $M_A$ in the apparatus 31 and the method of controlling its temperature are essentially the same as outlined in FIG. 8.

FIG. 16 is a plan view showing the general layout of an apparatus for producing a semisolid shaping metal which is indicated by 102 and which has a moving crystal generating section 30 comprising a cooling zone 47 and a temperature adjusting zone 48 having an induction apparatus 31.

The apparatus 102 comprises a holding vessel conditioning section 10, the crystal generating section 30, a melt pouring section 40, a nucleating section 50 and a vessel transporting section 60. A shaping apparatus indicated by 200 in FIG. 16 is an example of the machine for shaping a semisolid metal $M_B$ produced with the apparatus 102 of the invention.

FIG. 17*a* is a plan view showing details of the crystal generating section of the apparatus shown in FIG. 16 and FIG. 17*b* is vertical section B—B of FIG. 17*a*. The apparatus 102 is identical with what is shown in FIGS. 12 and 13, except for the crystal generating section. Therefore, only the crystal generating section 30 will be described below in detail.

As shown in FIGS. 17*a* and 17*b*, the crystal generating section 30 comprises a frame 34 capable of heat-retaining or heating the bottom portion of a holding vessel 1, a vertically movable lid 35 that is capable of heat-retaining or heating the top portion of the holding vessel 1 and which is furnished with a thermocouple 36 for measuring the temperature of the metal in the holding vessel 1, a cooling zone 47 comprising a cooling unit 37 which injects air or water of a specified temperature, as required, against the outer surface of the holding vessel 1, an automatic transport unit 49 for rotating the holding vessel 1 at a constant speed, and a temperature adjusting zone 48 having an induction apparatus 31 furnished with a heating coil 31*a* which is provided around the holding vessel 1 for controlling the temperature of the metal in it.

Only after a holding vessel 1*i* is rotated by means of the automatic transport unit 49 to come to the position of a holding vessel 1*m*, the induction apparatus 31 comes into action to adjust the temperature of the metal in the holding vessel 1. The apparatus 31 is either raised or lowered by a vertically moving cylinder 32 and stops in a specified position where it surrounds the holding vessel 1.

FIG. 18 is a plan view showing the general layout of an apparatus which is indicated by 103 and which has a stationary crystal generating section 30 comprising a cooling zone 47 and a temperature adjusting zone 48 having an induction apparatus 31. FIG. 19*a* is a plan view showing details of the crystal generating section of the apparatus shown in FIG. 18 for producing a semisolid shaping metal and FIG. 19*b* is vertical section C—C of FIG. 19*a*. The crystal generating section 30 comprises a frame 34 capable of heat-retaining or heating the bottom portion of the holding vessel 1, a vertically movable lid 35 that is capable of heat-retaining or heating the top portion of the holding vessel 1 and which is furnished with a thermocouple 36 for measuring the temperature of the metal in the holding vessel 1, a cooling zone 47 comprising a cooling unit 37 which injects air or water of a specified temperature, as required, against the outer surface of the holding vessel 1, and a temperature adjusting zone 48 having an induction apparatus 31 furnished with a heating coil 31*a* which is provided around the holding vessel 1 for controlling the temperature of the metal in it. Unlike in the case shown in FIGS. 16 and 17, the holding vessel 1 in the crystal generating section shown in FIG. 19 is of a stationary type and, therefore, the holding vessel 1 is transported by a robot 62 to the temperature-adjusting zone 48 after it has been cooled to a specified temperature by means of the cooling unit 37. Then, as in the case shown in FIG. 13, the holding vessel 1 is replaced on the ceramic frame 34 and the temperature of the metal in it is adjusted by means of the induction apparatus 31.

The criticality of the conditions for cooling the holding vessel in the step of spheroidizing primary crystals in the process shown in FIG. 9 may be explained as follows.

If the upper or lower portion of the holding vessel 1 is not heated or heat-retained while the alloy $M_B$ poured into the vessel is cooled to establish a fraction liquid suitable for molding, dendritic primary crystals are generated in the skin of the alloy $M_B$ in the top and/or bottom portion of the vessel or a solidified layer will grow to cause nonuniformity in the temperature distribution of the metal in the holding vessel 1; as a result, even if r-f induction heating is performed, the alloy having the specified fraction liquid cannot be discharged from the inverted vessel 1 or the remaining solidified layer within the holding vessel 1 either introduces difficulty into the practice of continued shaping operation or prevents the temperature distribution of the alloy from being improved in the desired way. In order to avoid these problems, if the poured metal is held in the vessel for a comparatively short time until the molding temperature is reached, the top and/or bottom portion of the holding vessel is heated or heat-retained at a higher temperature than the middle portion in the cooling process; if necessary, both the top and bottom portions of the holding vessel 1 may be heated not only in the cooling process after the melt pouring but also before the pouring step.

If the holding vessel 1 is made of a material having a thermal conductivity of less than 1.0 kcal/mh° C., the cooling time is prolonged to a practically undesirable level; hence, the holding vessel 1 should have a thermal conductivity of at least 1.0 kcal/mh° C. If the holding vessel 1 is made of a metal, its surface is preferably coated with a nonmetallic material (e.g. BN or graphite). The coating method may be either mechanical or chemical or physical.

If the alloy $M_A$ poured into the holding vessel 1 is cooled at an average rate faster than 3.0° C./s, it is not easy to permit the temperatures of various parts of the alloy to fall within the desired molding temperature range for establishment of the specified fraction liquid even if induction heating is employed and, in addition, it is difficult to generate spherical primary crystals. If, on the other hand, the average cooling rate is less than 0.01° C./s, the cooling time is prolonged to cause inconvenience in commercial production. Therefore, the average rate of cooling in the holding vessel 1 should range preferably from 0.01° C./s to 3.0° C./s, more preferably from 0.05° C./s to 1° C./s.

INDUSTRIAL APPLICABILITY

As will be understood from the foregoing description, the apparatus of the invention for producing semisolid shaping metals offers the advantage that shaped parts having fine and spherical microstructures can be mass-produced automatically and continuously in a convenient, easy and inexpensive manner without relying upon agitation by the conventional mechanical and electromagnetic methods.

What is claimed is:

1. An apparatus for producing a semisolid shaping metal that has fine primary crystals dispersed in the liquid phase and which also has a uniform temperature distribution, said apparatus comprising:

a melt pouring means comprising a melting furnace which melts and holds a metal and a pouring device which lifts out the molten metal from said melting furnace, adjusts it to a specified temperature and pours it into a holding vessel;

a nucleating means which generates crystal nuclei in the melt as it is supplied from said pouring device into said holding vessel;

a crystal generating means which performs temperature adjustment such that the metal obtained from said nucleating section falls within a desired molding temperature range as it is cooled to a molding temperature at which it is partially solid, partially liquid;

a holding vessel conditioning means which inverts the holding vessel by turning it upside down so that a partially molten metal is discharged and which then cleans the inner surfaces of the holding vessel; and a vessel transporting means furnished with an automating device including a robot with which the partially molten metal from said nucleating means is transported into the injection sleeve of a molding machine.

2. The apparatus according to claim 1, wherein the melt pouring means comprises:

(1) a high-temperature melt holding furnace and a low-temperature melt holding furnace furnished with a pouring ladle; or (2) a pouring ladle furnished with a refiner feed unit and a temperature control cooling jig inserting device and a high-temperature melt holding furnace; or (3) a low-temperature melt holding furnace furnished with a pouring ladle and a refiner-rich melt holding furnace also furnished with a pouring ladle; or (4) a pouring ladle furnished with a refiner melting radio-frequency induction heater and a low-temperature melt holding vessel; or (5) a low-temperature melt holding vessel furnished with a pouring ladle; and wherein the nucleating means is the holding vessel.

3. The apparatus according to claim 2, wherein the nucleating means comprises either a holding vessel tilting or inverting unit by which the angle of inclination of the holding vessel can be varied freely and automatically as required during and after pouring of the melt in accordance with its volume, or a holding vessel cooling accelerating unit capable of cooling said holding vessel externally during and after pouring of the melt, or both of said holding vessel tilting or inverting unit and said holding vessel cooling accelerating unit.

4. The apparatus according to claim 1, wherein the melt pouring means is a low-temperature melt holding furnace furnished with a pouring ladle and wherein the nucleating means comprises a vibrating jig and the holding vessel, said vibrating jig being capable of vertical movement and imparting vibrations to the melt as it is poured into said holding vessel.

5. The apparatus according to claim 1, wherein the melt pouring means is a melt holding furnace furnished with a pouring ladle and wherein the nucleating means comprises an inclining cooling jig and the holding vessel, said cooling jig being such that the angle of inclination can be varied freely and automatically during and after pouring of the melt in accordance with its volume.

6. The apparatus according to claim 1, wherein the crystal generating means comprises:

a vertically movable frame on which the holding vessel is placed and which is either furnished with a heating source for heating the bottom portion of said holding vessel or formed of an insulating material for heat-retaining said bottom portion;

a vertically movable lid that is either furnished with a heating source for heating the top portion of said holding vessel or formed of an insulating material for heat-retaining said top portion and which is furnished with a temperature sensor for measuring the temperature of the metal in the holding vessel; and a cooling unit provided exterior to said holding vessel for injecting air of a specified temperature against the outer surface of said holding vessel.

7. The apparatus according to claim 6, wherein the crystal generating means comprises:

a frame that is capable of heat-retaining or heating the bottom portion of the holding vessel and which is vertically movable for retaining or lifting out said holding vessel and for adjusting its position within the heating coil of the induction apparatus;

a vertically movable lid that is capable of heat-retaining or heating the top portion of said holding vessel and which is furnished with a temperature sensor for measuring the temperature of the metal in the holding vessel;

an induction apparatus furnished with a heating coil which is provided around the holding vessel for controlling the temperature of the melt in the holding vessel; and a cooling unit provided exterior to said heating coil for injecting air of a specified temperature against the outer surface of said holding vessel.

8. The apparatus according to claim 6, wherein the crystal generating means comprises:

an induction apparatus furnished with a heating coil which is provided around the holding vessel for controlling the temperature of the metal in the holding vessel;

a frame that is capable of heat-retaining or heating the bottom portion of the holding vessel and which is not only vertically movable but also rotatable for retaining, lifting out or replacing said holding vessel and for adjusting its position within the heating coil of the induction apparatus;

a vertically movable lid that is capable of heat-retaining or heating the top portion of said holding vessel and which is furnished with a temperature sensor for measuring the temperature of the metal in the holding vessel; and a cooling unit provided exterior to said heating coil for injecting air of a specified temperature against the outer surface of said holding vessel, and wherein the crystal generating means comprises a plurality of units which rotate or pivot about a single axis.

9. The apparatus according to claim 6, wherein the crystal generating means comprises:

a frame that is capable of heat-retaining or heating the bottom portion of the holding vessel;

a vertically movable lid that is capable of heat-retaining or heating the top portion of said holding vessel and which is furnished with a temperature sensor for measuring the temperature of the metal in the holding vessel;

a cooling zone comprising a cooling unit which injects air or water of a specified temperature, as required, against the outer surface of said holding vessel; and a temperature adjusting zone having an induction apparatus furnished with a heating coil which is provided around said holding vessel for controlling the temperature of the metal in said holding vessel.

10. The apparatus according to claim 9, wherein the crystal generating means further includes an automatic transport unit with which the holding vessel containing the metal cooled to a specified temperature in the cooling zone is moved at a specified speed to the temperature adjusting zone which is adapted to be such that either the heating coil of the induction apparatus or the holding vessel moves so that the temperature of the metal in the holding vessel is controlled within the heating coil.

11. The apparatus according to claim 9, wherein the crystal generating means further includes a transport unit comprising an automating device including a robot with which the holding vessel containing the metal cooled to a specified temperature in the cooling zone is moved to the temperature adjusting zone which is adapted to be such that either the heating coil of the induction apparatus or the holding vessel moves so that the temperature of the metal in the holding vessel is controlled within the heating coil.

12. The apparatus according to claim 1, wherein the holding vessel conditioning means comprises:

at least two of the following three units, a holding vessel cooling unit that is capable of rotary and vertical movements and which is also capable of injecting at least one of a gas, a liquid and a solid material, an air blowing unit that is capable of rotary and vertical movements and optional air injection, and a cleaning unit for cleaning the inner surfaces of the holding vessel which has a brush that is capable of rotary and vertical movements and air injection;

a spray unit that is capable of rotary and vertical movements and application of a nonmetallic coating; and a holding vessel rotating and transporting unit with which the holding vessel, with its opening facing down, can be moved to and fixed on the top portion of each of said cooling unit, said air blowing unit and said cleaning unit, and which is vertically movable.

13. The apparatus according to claim 1, wherein the holding vessel conditioning means comprises a cleaning unit and a spray unit, said cleaning unit comprising a jig for cleaning the inner surfaces of the holding vessel which has a brush that is capable of rotary and vertical movements and air injection and a vertically movable jig for fixing the holding vessel, and said spray unit comprising a vertically movable jig for applying a nonmetallic coating onto the inner surfaces of the holding vessel and a vertically movable jig for fixing the holding vessel.

14. The apparatus according to claim 1, which further includes a holding vessel heating means for adjusting the temperature of the holding vessel when it is empty.

* * * * *